US009764525B2

(12) United States Patent
Pettersson et al.

(10) Patent No.: US 9,764,525 B2
(45) Date of Patent: Sep. 19, 2017

(54) BOX GLUING DEVICE

(71) Applicant: Packsize, LLC, Salt Lake City, UT (US)

(72) Inventors: Niklas Pettersson, Vasteras (SE); Ryan Osterhout, West Haven, UT (US); Hanko Kiessner, Salt Lake City, UT (US)

(73) Assignee: PACKSIZE LLC, Salt Lake City, UT (US)

( * ) Notice: Subject to any disclaimer, the term of this patent is extended or adjusted under 35 U.S.C. 154(b) by 0 days.

(21) Appl. No.: 15/099,052

(22) Filed: Apr. 14, 2016

(65) Prior Publication Data

US 2016/0229145 A1 Aug. 11, 2016

Related U.S. Application Data

(62) Division of application No. 13/129,093, filed as application No. PCT/US2009/064248 on Nov. 12, 2009, now Pat. No. 9,339,984.

(Continued)

(51) Int. Cl.
*B31B 3/00* (2006.01)
*B31B 1/00* (2006.01)

(Continued)

(52) U.S. Cl.
CPC ..... *B31B 1/62* (2013.01); *B31B 1/00* (2013.01); *B31B 3/00* (2013.01); *B31B 3/60* (2013.01);

(Continued)

(58) Field of Classification Search
CPC ..... B31B 3/00; B31B 1/62; B31B 2201/6017

(Continued)

(56) References Cited

U.S. PATENT DOCUMENTS 2,169,311 A * 8/1939 Widell ..... B31B 1/28 493/269
2,637,251 A 5/1953 Spiess (Continued)

FOREIGN PATENT DOCUMENTS

CN 1810501 8/2006
CN 101094766 12/2007

(Continued)

OTHER PUBLICATIONS

International Search Report and Written Opinion for PCT/US2009/064248 dated Dec. 29, 2009.

(Continued)

*Primary Examiner* — Andrew M Tecco
*Assistant Examiner* — Chelsea Stinson
(74) *Attorney, Agent, or Firm* — Workman Nydegger

(57) ABSTRACT

A box gluing device for attaching a glue tab of a box blank to an opposing panel when the box blank is folded so the glue tab is position at an edge of the box blank. The gluing device includes a support structure upon which a gluing apparatus and a support plate are mounted. The gluing apparatus a glue dispensing nozzle for applying glue on one or more surfaces of the box blank. The box blank can be moved through the gluing device to attach the glue tab to the opposing panel. As the box blank moves through the gluing device, a guide rail orients the glue tab in a desired manner while glue is applied to the box blank, and a roller assembly presses the glue tab and the opposing panel together with the glue therebetween. Alternatively, the gluing device can include a clamp arm that holds the box blank in place while glue is applied, and a folding bar that folds the glue tab onto the opposing panel after glue is applied.

19 Claims, 13 Drawing Sheets

Related U.S. Application Data

(60) Provisional application No. 61/114,282, filed on Nov. 13, 2008, provisional application No. 61/259,211, filed on Nov. 8, 2009.

(51) Int. Cl.
*B31B 1/62* (2006.01)
*B31B 3/60* (2006.01)

(52) U.S. Cl.
CPC . *B31B 2201/267* (2013.01); *B31B 2201/2691* (2013.01); *B31B 2201/6017* (2013.01); *B31B 2203/066* (2013.01); *B31B 2203/082* (2013.01)

(58) Field of Classification Search
USPC ..... 493/127, 129, 68, 69
See application file for complete search history.

(56) References Cited

U.S. PATENT DOCUMENTS

| | | | | |
|---|---|---|---|---|
| 2,690,156 | A | 9/1954 | Shields | |
| 2,848,926 | A | 8/1958 | Gschwind | |
| 2,984,598 | A * | 5/1961 | Gobalet | B31B 1/60 118/DIG. 3 |
| 3,061,167 | A | 10/1962 | Haack | |
| 3,105,419 | A | 10/1963 | La Bombard | |
| 3,358,567 | A * | 12/1967 | Tucker | B31B 3/00 493/141 |
| 3,461,642 | A * | 8/1969 | Langen | B31B 3/00 493/129 |
| 3,884,130 | A | 5/1975 | Stolkin et al. | |
| 3,964,374 | A | 6/1976 | Stolkin et al. | |
| 4,063,492 | A * | 12/1977 | Lesek | B31B 3/00 493/176 |
| 4,119,058 | A | 10/1978 | Schmermund | |
| RE30,325 | E | 7/1980 | Waldbauer | |
| 4,272,235 | A * | 6/1981 | Barnett | B29C 53/04 156/443 |
| 4,368,052 | A | 1/1983 | Bitsky et al. | |
| 4,516,210 | A | 5/1985 | Dahlke | |
| 4,608,038 | A | 8/1986 | Virta et al. | |
| 4,636,185 | A | 1/1987 | Carter et al. | |
| 4,894,104 | A | 1/1990 | Hemus | |
| 5,071,401 | A | 12/1991 | Bertsch | |
| 5,090,616 | A | 2/1992 | Bertsch | |
| 5,188,695 | A | 2/1993 | Colton | |
| 5,236,408 | A | 8/1993 | McAdam, III et al. | |
| 5,863,380 | A | 1/1999 | Gambetti | |
| 6,066,080 | A | 5/2000 | Benoit | |
| 6,419,750 | B1 | 7/2002 | Tabak | |
| 6,673,152 | B2 * | 1/2004 | Guzzon | B31B 1/62 118/315 |
| 7,601,218 | B2 | 10/2009 | Stepaniak | |
| 9,339,984 | B2 | 5/2016 | Pettersson | |
| 2003/0084846 | A1 | 5/2003 | Guzzon et al. | |
| 2006/0100079 | A1 * | 5/2006 | Graham | B31B 1/36 493/71 |
| 2011/0294638 | A1 | 12/2011 | Tosevski | |
| 2012/0028776 | A1 | 2/2012 | Pettersson | |
| 2014/0371045 | A1 | 12/2014 | Bruneau | |

FOREIGN PATENT DOCUMENTS

| | | |
|---|---|---|
| CN | 200998927 | 1/2008 |
| CN | 201128254 | 10/2008 |
| CN | 102264532 | 11/2011 |
| CN | 102264533 | 11/2011 |
| DE | 229667 | 11/1985 |
| DE | 3519017 | 11/1986 |
| EP | 2364250 | 9/2011 |
| EP | 2364251 | 9/2011 |
| GB | 2085791 | 5/1982 |
| GB | 2103145 | 2/1983 |
| JP | 56122295 | 9/1981 |
| JP | 57192829 | 11/1982 |
| JP | 58024434 | 2/1983 |
| JP | 5991077 | 5/1984 |
| JP | 64044739 | 2/1989 |
| JP | 05-508141 | 11/1993 |
| JP | 07-330206 | 12/1995 |
| JP | 2001171019 | 6/2001 |
| JP | 2001205988 | 7/2001 |
| JP | 2004058665 | 2/2004 |
| JP | 2005280802 | 10/2005 |
| JP | 2006110724 | 4/2006 |
| JP | 2008006092 | 1/2008 |
| JP | 2009166625 | 7/2009 |
| JP | 2012508661 | 4/2012 |
| JP | 2012509778 | 4/2012 |
| RU | 2011123972 | 12/2012 |
| RU | 2011123973 | 12/2012 |
| WO | 92-08653 | 5/1992 |
| WO | 9308979 | 5/1993 |
| WO | 2010056894 | 5/2010 |
| WO | 2010057053 | 5/2010 |

OTHER PUBLICATIONS

International Search Report and Written Opinion for PCT/US2009/064477 dated Dec. 29, 2009.
European Search Report for EP09826874 dated Feb. 13, 2015.
European Search Report for EP09826772 dated Feb. 13, 2015.
European Search Report for EP09826772 dated Jun. 30, 2015.
U.S. Appl. No. 13/129,093, Nov. 5, 2014, Office Action.
U.S. Appl. No. 13/129,095, Nov. 5, 2014, Office Action.
U.S. Appl. No. 13/129,093, Apr. 23, 2015, Final Office Action.
U.S. Appl. No. 13/129,095, May 1, 2015, Final Office Action.
U.S. Appl. No. 13/129,095, Sep. 2, 2015, Office Action.
U.S. Appl. No. 13/129,093 Jan. 15, 2016, Notice of Allowance.
U.S. Appl. No. 13/129,095, Mar. 9, 2016, Final Office Action.
U.S. Appl. No. 13/129,095, Jun. 27, 2016, Notice of Allowance.
U.S. Appl. No. 15/258,612, Apr. 7, 2017, Office Action.

* cited by examiner

BOX GLUING DEVICE

CROSS-REFERENCE TO RELATED APPLICATIONS

This application is a divisional of U.S. patent application Ser. No. 13/129,093, filed on May 12, 2011, and entitled "BOX GLUING DEVICE," which is a §371 National State Application of International Application Serial Number PCT/US2009/064248, filed on Nov. 12, 2009, and entitled "BOX GLUING DEVICE," which claims the benefit of, and priority to, U.S. Provisional Patent Application Ser. No. 61/114,282, filed on Nov. 13, 2008, and entitled "BOX GLUING DEVICE" and U.S. Provisional Patent Application Ser. No. 61/259,211, filed on Nov. 8, 2009, and entitled "AUTOMATED BOX GLUING DEVICE," which are hereby expressly incorporated herein by this reference in their entireties.

BACKGROUND OF THE INVENTION

1. Technical Field

Exemplary embodiments of the invention relate to the manufacture and construction of packaging materials. More particularly, embodiments relate to devices, systems, and methods for gluing packaging materials, such as packaging templates formed of corrugated board.

2. The Relevant Technology

Numerous devices are used in the corrugated board industry to convert a cut-out box blank into a corrugated box. Some of these devices are able to cut, crease, fold and/or glue corrugated blanks in order to create a box. The gluer is often grouped as one in a series of machines operating to convert paperboard blanks, one-by-one, into boxes. The gluer ordinarily receives a folded blank with four side-by-side panels which are separated from one another by longitudinal creases and slots. Each of the panels also includes opposing flaps which can be folded to form the top and bottom of the box. Additionally, one of the panels also includes a glue tab. The gluer applies glue to the glue tab and/or an adjacent panel and presses the glue tab against the adjacent panel, thereby creating a box with four connected sides.

Typical gluers are relatively complex machines. These machines often have conveyer belts for advancing the corrugated blanks through the machine. Typical gluers also include glue applicators that may be mechanically driven along a portion of the corrugated blank in order to apply glue to the glue tab. Additionally, many gluers include means for applying pressure to the glue tab, such as a pneumatic arm, in order to bond the glue to the glue tab and the adjacent panel. Because of these many features and the need to ensure proper timing of the various moving parts, gluers often have computers or other electronics that control the operation of the various parts of the machine. For example, the computer or other electronics may coordinate the timing and control the operation of one or more pneumatic arms for folding the box blank, a glue applicator for applying glue to the box blanks, and a compression device for applying pressure to the glued portions of the box blank. The complex nature of these gluers, with the numerous moving parts and electronics, increases the cost of the machines and often requires significant maintenance and operating expenses.

In addition to their relatively complex nature, typical gluers are often very large. A corrugated blank that is glued with a typical gluer is usually folded such that the glue flap extends down the middle of the corrugated blank. Gluers are therefore made with a large C-shaped frame. The bottom portion of the frame supports the corrugated blank during the gluing process. The top portion of the frame, which includes the glue applicator, extends over the top of the corrugated blank so as to be able to reach the glue flap in the middle of the corrugated blank. For larger sized corrugated blanks, gluers with even larger sized frames are needed. These large gluing machines can occupy valuable space in a manufacturing or other type of facility.

The subject matter claimed herein is not limited to embodiments that solve any disadvantages or that operate only in environments such as those described above. Rather, this background is only provided to illustrate one exemplary technology area where some embodiments described herein may be practiced

BRIEF SUMMARY OF THE INVENTION

Exemplary embodiments of the invention relate to the manufacture and construction of packaging materials. More particularly, embodiments relate to devices, systems, and methods for gluing packaging materials, such as packaging templates formed of corrugated board.

According to one embodiment of the present invention, a gluing device includes a support structure upon which a gluing apparatus and a support plate assembly are mounted. The gluing apparatus has a glue supply and a glue dispensing nozzle for applying glue between two surfaces of a packaging material. The two surfaces of the packaging material can be disposed on an edge or outer perimeter of the packaging material. The support plate assembly includes a support plate upon which the packaging material can move. The support plate assembly also includes a guide rail to facilitate proper positioning of the packaging material upon the support plate as the packaging material is moved on the support plate. Additionally, the support plate assembly also includes a roller assembly for pressing the two surfaces of the packaging material together after glue has been applied between the two surfaces of the packaging material. Optionally, the roller assembly can be motorized to facilitate feeding of the packaging material through the gluing device.

According to another embodiment of the present invention, a method for constructing a box includes providing a box blank that has a plurality of side-by-side panels and a glue tab extending from one of the panels. A crease or score is disposed between the side-by-side panels and the glue tab to facilitate folding of the box blank. The box blank is folded into a generally rectangular shape along the creases or scores so that the glue tab and an edge of one of the panels other than the panel from which the glue tab extends are positioned adjacent one another and on a perimeter of the folded box blank. The folded box blank is then inserted into a gluing device. The gluing device includes a guide rail against which the perimeter of the folded box blank that includes the glue tab can be positioned. The folded box blank is moved along the guide rail so that a glue dispensing nozzle extends between the glue tab and the adjacent panel to apply glue therebetween. The folded box blank is then moved past the glue dispensing nozzle and through a roller assembly to press the glue tab, the glue, and the adjacent panel together. The roller assembly can be motorized to facilitate feeding of the box blank through the gluing device.

In yet another embodiment of the present invention, a gluing device includes a support structure with a support plate mounted thereon. The support plate is adapted to have packaging material positioned thereon for gluing. Also coupled to the support structure is a clamp arm. The clamp arm is adapted to selectively and securely hold the packaging material in place on the support plate during the gluing process. The clamp arm can be moved from a first position to a second position to hold the packaging material in place. The gluing device also includes a gluing apparatus that is movably mounted on the support structure so that the gluing apparatus can be moved back and forth across the support structure. The gluing apparatus has a glue dispensing nozzle and a glue supply. The gluing apparatus is adapted to apply glue to at least one surface of the packaging material, which surface(s) is disposed on an edge of the packaging material. The gluing device also includes a folding bar rotatably coupled to the support structure. The folding bar is adapted to fold a first portion of the packaging material onto a second portion of the packaging material to secure the two portions together.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The embodiments described herein extend to methods, devices, systems, assemblies, and apparatus for gluing objects. Such are configured to, for example, reliably glue objects in a simple and efficient manner.

Reference will now be made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner No inference should therefore be drawn from the drawings as to the necessity of any element. In the following description, numerous specific details are set forth in order to provide a thorough understanding of the present invention. It will be obvious to one of ordinary skill in the art, however, that the present invention may be practiced without these specific details. In other cases, well known aspects of gluing devices and methods, general manufacturing techniques, and packaging products are not described in detail herein in order to avoid unnecessarily obscuring the novel aspects of the present invention.

FIGS. 1-15 and the following discussion are intended to provide a brief general description of exemplary devices in which embodiments of the invention may be implemented. While gluing apparatuses for gluing packaging is described below, this is but one single example, and embodiments of the invention may be implemented with other types of glueable objects. Accordingly, throughout the specification and claims, the phrases "glueable object," "glueable item," "packaging material," "box blank," and the like are intended to apply broadly to any type of item that can be glued with a system or device as described herein.

Figure 1:
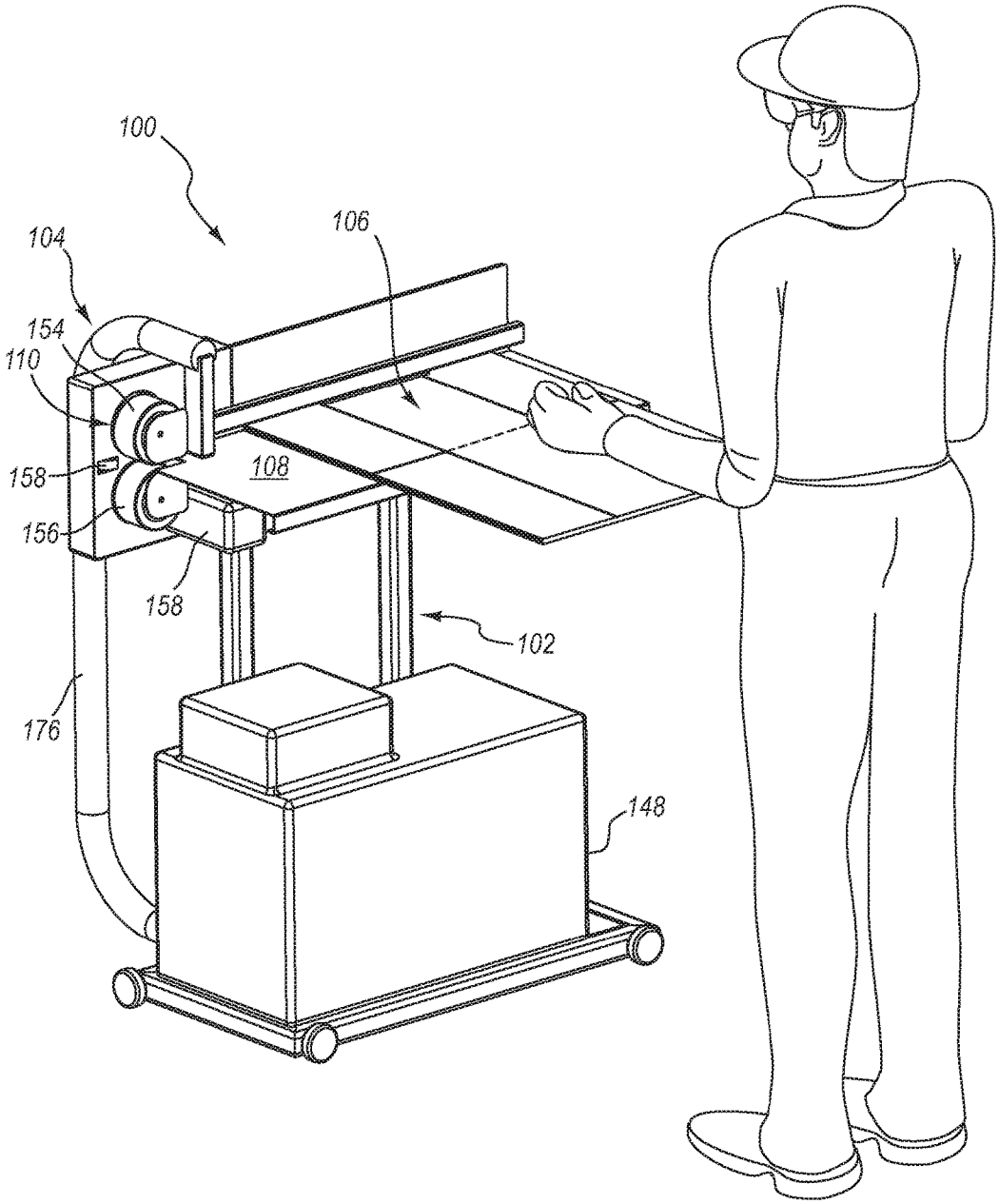
FIG. 1 illustrates an exemplary gluing device according to one embodiment of the present invention being used to glue a corrugated blank.

FIG. 1 thus illustrates one example of a suitable gluing device implementing some aspects of the present invention. The gluing device of FIG. 1 is only one example of a suitable device/system and is not intended to suggest any limitation as to the scope of use or functionality of an embodiment of the invention. Neither should the device/system be interpreted as having any dependency or requirement relating to any one or combination of components illustrated in the system/device.

With reference to FIG. 1, an exemplary gluing device 100 is broadly illustrated to include a support structure 102 and a gluing apparatus 104 which facilitates the gluing of packaging materials, box blanks, or other gluable objects or items, generally identified with reference numeral 106. In particular, device 100 includes a support plate 108 upon which packaging material 106 can be moved during a gluing process. Packaging material 106 can be moved along support plate 108 adjacent gluing apparatus 104 such that gluing apparatus 104 applies glue to a portion of packaging material 106. After glue is applied, packaging material 106 is moved through a roller assembly 110 to firmly apply the glue to two surfaces of packaging material 106. As described herein, some embodiments of roller assembly 110 are motorized to facilitate feeding of packaging material 106 through gluing device 100. Additionally, a motorized roller assembly 110 can be configured to stack packaging material 106 after the gluing process in complete. Thus, roller assembly 110 can free the operator to retrieve additional packaging material 106 for gluing with gluing device 100. Once packaging material 106 has been glued, and optionally stacked, additional packaging material 106 can be glued in a similar manner with gluing device 100.

Figure 2A:
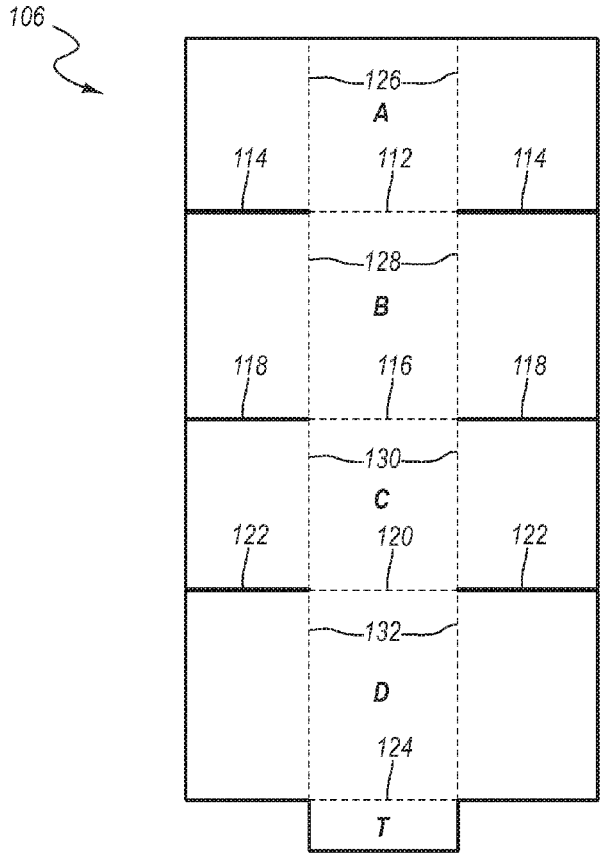
FIG. 2A illustrates a corrugated blank that can be glued with the gluing device of FIG. 1.
Figure 2B:
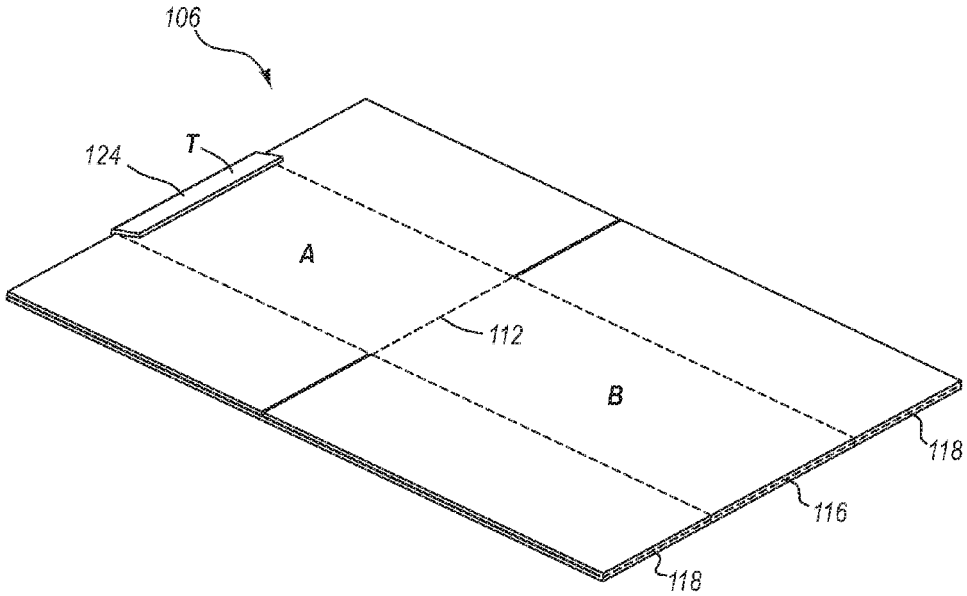
FIG. 2B illustrates the corrugated blank of FIG. 2A folded and ready to be glued by the gluing device of FIG. 1.

In FIGS. 2A and 2B, one example of a glueable object 106 is illustrated as being a corrugated box blank 106. Box blank 106 includes four side-by-side panels, designated as A, B, C, and D, and a glue tab T. Panels A and B are separated by a longitudinal crease or score 112 and cuts or slits 114. Likewise, panels B and C are separated by a longitudinal crease or score 116 and cuts or slits 118, and panels C and D are separated by a longitudinal crease or score 120 and cuts or slits 122. In the illustrated embodiment, glue tab T only extends along a portion of the width of panel D and is separated from panel D by a longitudinal crease or score 124. It will be appreciated, however, that glue tab T can extend along the entire width of panel D and can be separated from panel D by crease or score 124 as well as cuts or slits.

Panels A, B, C, and D additionally include transverse creases or scores 126, 128, 130, and 132, respectively, that cooperate with cuts or slits 114, 118, and 122 to define opposing flaps that can be folded to create the top and bottom portions of a box. The longitudinal and transverse creases, slots, and glue tab T can be formed with a creasing/slotting unit and/or a die cutter unit.

With the creases and slots formed in box blank 106, box blank 106 can be folded along the creases to begin forming a box. For instance, as shown in FIG. 2B, box blank 106 is first folded in half along crease 116. By folding along crease 116, panels A and B are positioned on top of panels D and C, respectively. Glue tab T can then be folded along crease 124 and attached to panel A as described herein. For reasons described below, it is notable that box blank 106 as folded in FIG. 2B has glue tab T positioned at an edge of box blank 106 rather than in the middle of box blank 106. It is also notable that glue tab T is positioned on the outside of panel A rather than inside the panel A.

As noted above, many gluing devices are configured to glue box blanks which are folded so the glue tab is positioned in the middle of the box blank, thus requiring a large frame that can reach the middle of the box blank in order to apply the glue to the glue tab. The gluing device of the present invention is adapted to glue a box blank when the box blank is folded so the glue tab is positioned on an edge of the box blank, as illustrated in FIG. 2B. The gluing device of the present invention thereby eliminates the need for a large frame in order to apply glue to the glue tab. Rather, the gluing device of the present invention is able to apply glue to any size box blank without any adjustment, while maintaining the compact nature of the device. This allows the gluing device of the present invention to be located in close proximity to other machines that may be used in making boxes, such as die cutters, cutting/creasing machines, erectors, and sealers. Thus, the gluing device of the present invention not only minimizes the amount of space used in a factory or warehouse, but also decreases the time necessary to form a box because the close proximity between the various machines reduces the time it takes an operator to move from one machine to another while processing a box blank.

Figure 3:
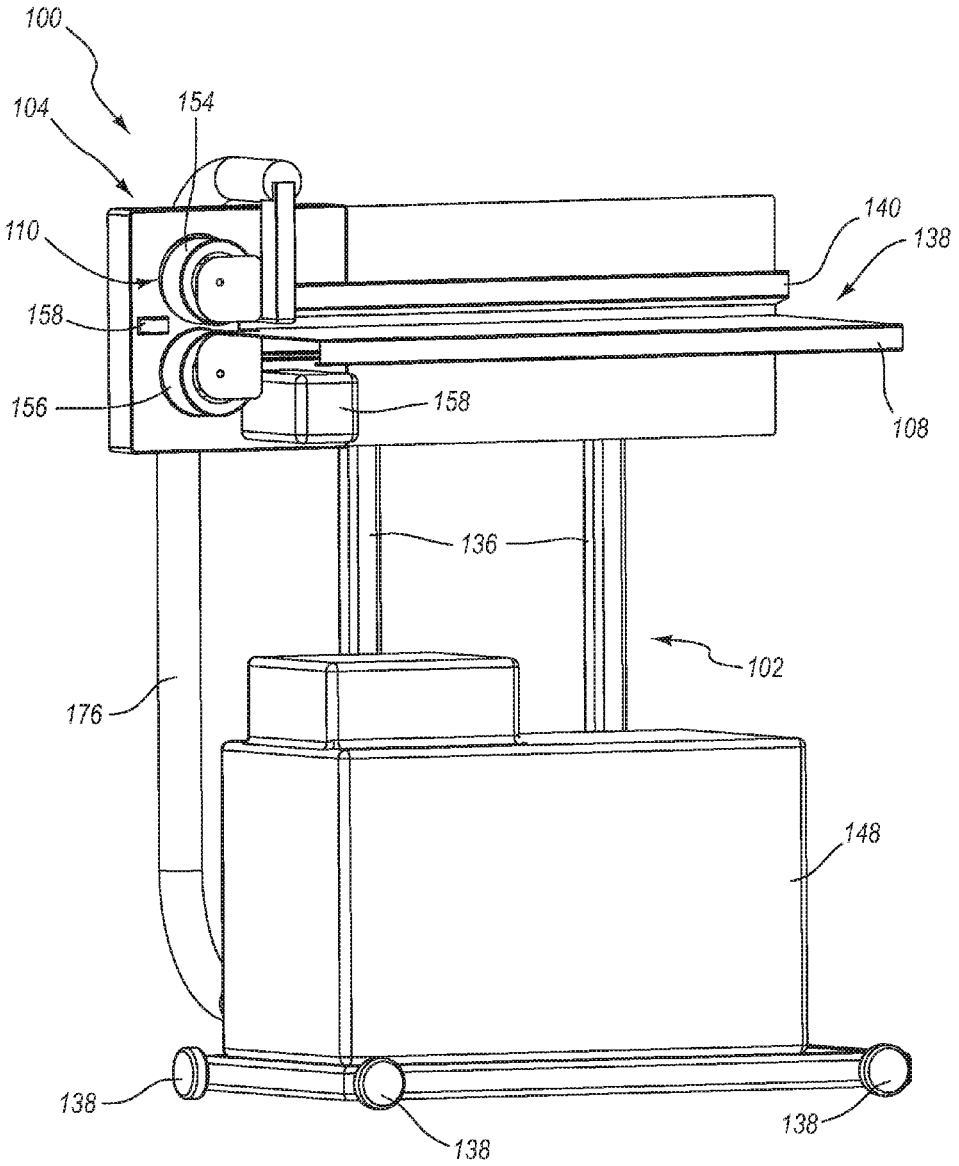
FIG. 3 illustrates a perspective view of the gluing device of FIG. 1.

Turning now to FIG. 3, a perspective view of gluing device 100 according one embodiment of the present invention is illustrated. As seen in FIG. 3, gluing device 100 includes support structure 102 upon which other components of gluing device 100 are mounted or attached. In the illustrated embodiment, support structure 102 includes a base frame 134 and an upright frame 136 that is supported by base frame 134. Optionally, base frame 134 can have wheels or casters 138 attached thereto to facilitate movement of gluing device 100 from one place to another. Wheels or casters 138 can be equipped with brakes or otherwise configured to selectively prevent rolling of wheels or caster 138.

As noted, support structure 102 has various components of gluing device 100 mounted thereon or attached thereto. One of the components that is attached near the top of upright frame 136 is a support plate assembly 138. Support plate assembly 138 includes support plate 108, which is adapted to support box blank 106 thereon as box blank 106 moves through gluing device 100. Support plate 108 can be sized to receive different sized box blanks 106, or portions thereof. For instance, support plate 108 can be sized to support only an edge of box blank 106 or the entirety of box blank 106. Thus, support plate 108 can have nearly any dimensions needed to support box blanks 106. Alternatively, support plate 108 can be positioned adjacent a table, counter, shelf, or the like, that can assist in supporting box blank 106. For instance, in FIG. 6 a table is positioned next to an edge of support plate 108 so that support plate 108 or an operator does not have to support all of box blank 106. Increasing the size of support plate 108 or positioning a table next to support plate 108 can be particularly helpful when a large box blank 106 is being glued by gluing device 100.

Support plate assembly 138 also includes a guide rail 140 that facilitates the proper positioning of box blank 106 on support plate 108 so that glue can be applied to the proper parts of box blank 106. As can be seen in the embodiment illustrated in FIGS. 3 and 4, guide rail 140 and support plate 108 cooperate to form a channel 141 that extends at least partially along the length of support plate assembly 138. Channel 141 opens toward support plate 108 and is sized to receive the edge of a folded box blank 106 therein. Additionally, channel 141 is configured to properly orient and align box blank 106 with a glue applicator 142, which is described in greater detail below. More particularly, the illustrated embodiment of channel 141 includes generally horizontal support plate 108, a substantially vertical wall 144, and an angled ceiling portion 146.

Figure 5A:
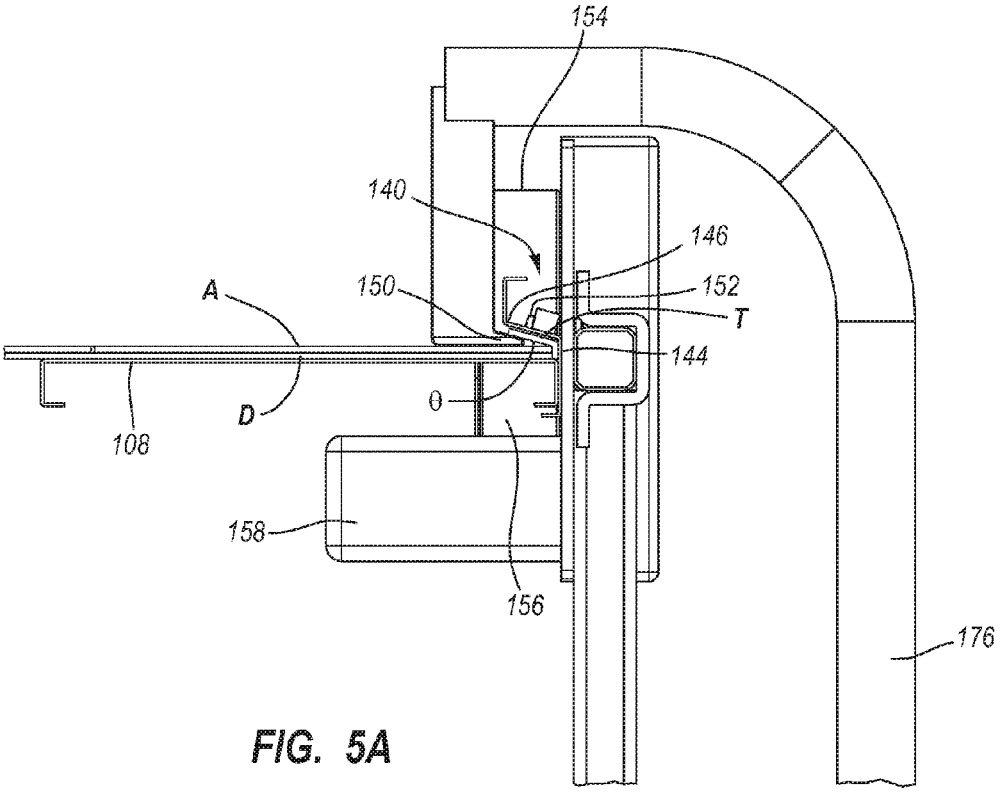
FIG. 5A is an end view of the support plate assembly of the gluing device of FIG. 1 illustrating a corrugated blank being glued.

Once box blank 106 has been folded as shown in FIG. 2B, the portion of box blank 106 including glue tab T is positioned on support plate 108 so that at least a portion of box blank 106 is within channel 141, as shown in FIG. 5A. That is, crease 124 between panel D and glue tab T is positioned against vertical wall 144 and glue tab T is held partially folded at an angle θ by ceiling 146. Positioning crease 124 against vertical wall 144 allows an operator to quickly, easily, and correctly position box blank 106 in and move box blank 106 through gluing device 106. More specifically, the operator can move box blank 106 through gluing device 100 in the proper orientation by holding box blank 106 such that crease 124 slides against vertical wall 144.

As discussed below, ceiling 146 holds glue tab T at an angle θ that allows glue applicator 142 to apply glue between glue tab T and panel A, and allows glue tab T and panel A to be pressed together after glue has been applied therebetween without damaging glue tab T. In this manner, an operator can quickly, conveniently, and correctly position box blank 106 on support plate 108 without requiring the operator to visually inspect the position of box blank 106. As discussed below, support plate 108 can take a form other than a planar surface as illustrated in FIGS. 1 and 3-6. For example, support plate 108 can comprise one or more rollers, conveyor belts, and the like. Alternatively, some embodiments of gluing device 100 do not include support plate 108. In such embodiments, other components of gluing device 100 and/or an operator or separate structure (i.e., a table) can provide support to box blank 106 as it moves through gluing device 100.

It will be appreciated by one of skill in the art that guide rail 140 can be configured in any of various manners without departing from the present invention. As described below, for example, guide rail 140 can be formed by a plurality of rollers that are configured to properly align or orient box blank 106 as it moves through gluing device 100.

Figure 4:
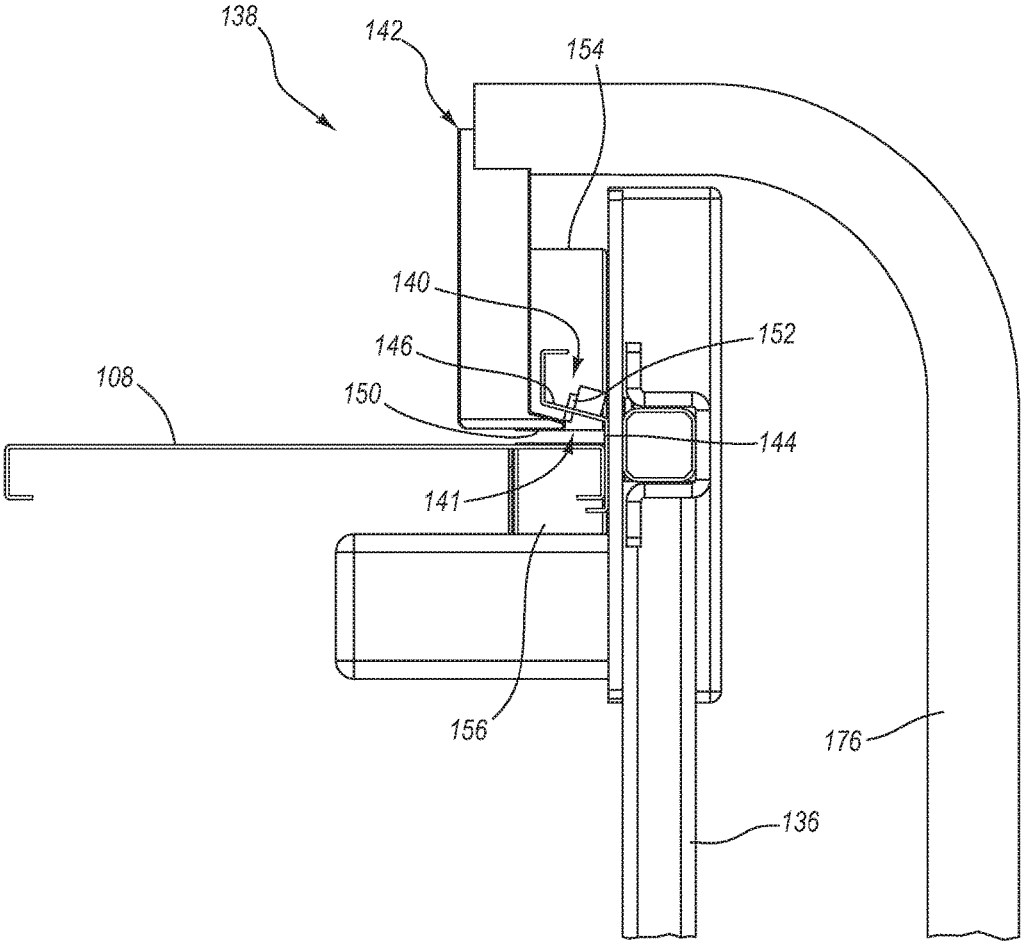
FIG. 4 illustrates an end view of a support plate assembly of the gluing device of FIG. 1.

As noted, support plate assembly 138 also has a glue applicator 142 attached thereto. Glue applicator 142 is connected to a glue source 148 (see FIG. 3) which will be described below. Glue applicator 142 includes a glue dispensing nozzle 150 positioned adjacent to guide rail 140 and support plate 108. In the illustrated embodiment, glue dispensing nozzle 150 is positioned just far enough above support plate 108 to allow panels A and D of box blank 106 to move on top of support plate 108 and beneath glue dispending nozzle 150. Additionally, glue dispensing nozzle 150 is shaped, oriented, or otherwise configured, as illustrated in FIGS. 4 and 5, so as to dispense glue in a desired direction. For example, in the illustrated embodiment, glue dispensing nozzle 150 is shaped to fit between panel A and glue tab T of box blank 106 when glue tab T is partially folded over panel A.

The above-described configuration of glue dispensing nozzle 150 facilitates application of glue on the proper parts of box blank 106. As seen in FIG. 5, for instance, as box blank 106 moves along support plate 108 to gluing apparatus 104, glue dispensing nozzle 150 is configured to extend at least partially underneath glue tab T. While glue dispensing nozzle 150 is positioned underneath glue tab T, glue is dispensed onto glue tab T and/or near the edge of panel A. In other embodiments, glue dispensing nozzle 150 may not extend underneath glue tab T but may still be able to apply glue between glue tab T and panel A. In either situation, glue can be applied between glue tab T and panel A to enable the two parts to be glued together.

While glue dispensing nozzle 150 is illustrated as being oriented in the general direction of guide rail 140 so as to be able to attach glue tab T on the outside of panel A, it will be appreciated that glue dispensing nozzle 150 can be oriented in other directions as well. For example, glue dispensing nozzle 150 can be oriented in the opposite direction to fit between glue tab T and panel A when glue tab T is glued on the inside of panel A. Additionally, glue dispensing nozzle 150 can be adjustably mounted to support plate assembly 138 such that glue dispensing nozzle 150 can be selectively adjusted to enable gluing of glue tab T on either the inside or outside of panel A, or to accommodate thicker or thinner box blanks 106.

The dispensing of glue through glue dispensing nozzle 150 can be controlled by various mechanical mechanisms. For example, once box blank 106 is positioned so that glue dispensing nozzle 150 is adjacent glue tab T, the operator of gluing device 100 may activate glue dispensing nozzle 150 by way of a button, lever, switch, pedal, or the like (not shown) to begin application of the glue to box blank 106. Once a desired amount of glue has been applied to glue tab T and/or panel A, the operator can deactivate glue dispensing nozzle 150 using the same or a different button, lever, switch, pedal, or the like.

Alternatively, gluing device 100 can be equipped with an automated system that detects the presence of box blank 106 and automatically begins to dispense glue to glue tab T and/or panel A. The automated system can also detect when sufficient glue has been applied to glue tab T and/or panel A or when glue tab T and/or box blank 106 is no longer present at glue dispensing nozzle 150. In either case, the automated system will deactivate glue dispensing nozzle 150 to stop the flow of glue therefrom.

In the exemplary embodiment illustrated in FIGS. 4 and 5, for instance, the automated system includes one or more sensors 152 for detecting the presence of box blank 106 and/or glue tab T. The one or more sensors 152 can be mounted to upright frame 136, guide rail 140, support plate 108, or gluing apparatus 104 so that the sensors 152 detect the presence or approach of box blank 106 and/or glue tab T and activate glue dispensing nozzle 150 when glue dispensing nozzle 150 is positioned between glue tab T and panel A. Examples of suitable sensors for use as the one or more sensors 152 include, but are not limited to infrared sensors, laser sensors, photodetector, proximity sensor, video camera, ultrasonic sensor, sonar sensor, radar sensor, or any combination thereof.

As noted above, support plate assembly 138 also includes roller assembly 110. In the embodiment illustrated in FIGS. 1 and 3-5B, roller assembly 110 includes two rollers 154, 156 positioned adjacent the dispensing nozzle, generally one above another. Rollers 154, 156 rotate in the same vertical plane as one another, but in opposite directions so as to advance box blank 106 therethrough. Specifically, roller 154 rotates in a clockwise direction and roller 156 rotates in a counterclockwise direction. Roller 156 is positioned such that its outer circumferential edge is at approximately the same level as or slightly higher than support plate 108. Roller 154 is positioned just far enough above roller 156 to allow box blank 106 to move between rollers 154, 156. As box blank 106 moves along support plate 108 past glue dispensing nozzle 150, the portion of box blank 106 that includes glue tab T and the adjacent edges of panels A and D pass between rollers 154, 156. Rollers 154, 156 are adapted to press glue tab T and panels A and D together, with the glue therebetween, in order to firmly attach glue tab T to panel A.

Additionally, in some embodiments rollers 154, 156 are attached to a motor 158 such that rollers 154, 156 facilitate movement of box blank 106 along support plate 108. Furthermore, a motorized roller assembly 110 can be adapted to facilitate stacking of glued box blanks 106 after they have been glued as described herein.

Figure 5B:
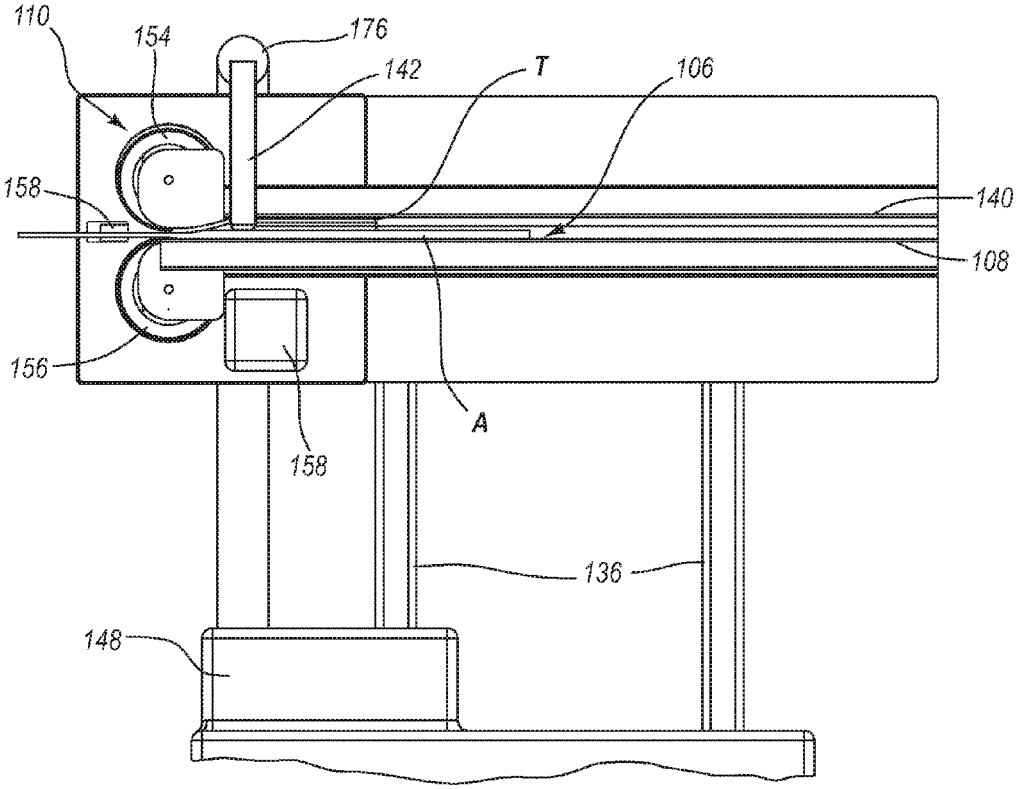
FIG. 5B is a side view of the support plate assembly illustrating a corrugated blank being glued.
Figure 6:
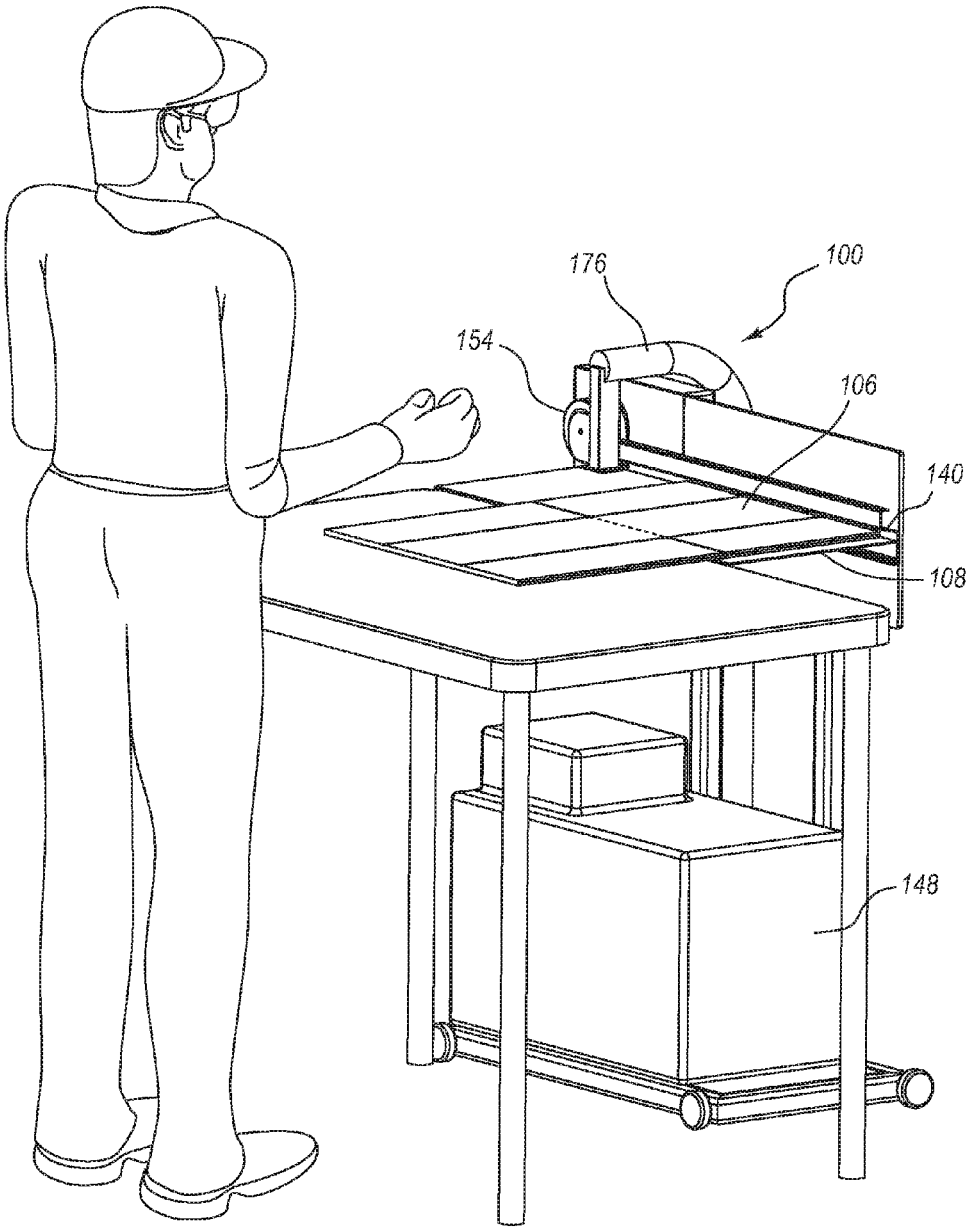
FIG. 6 illustrates the gluing device of FIG. 1 with an extended support structure for supporting a corrugated blank during the gluing process.
Figure 7:
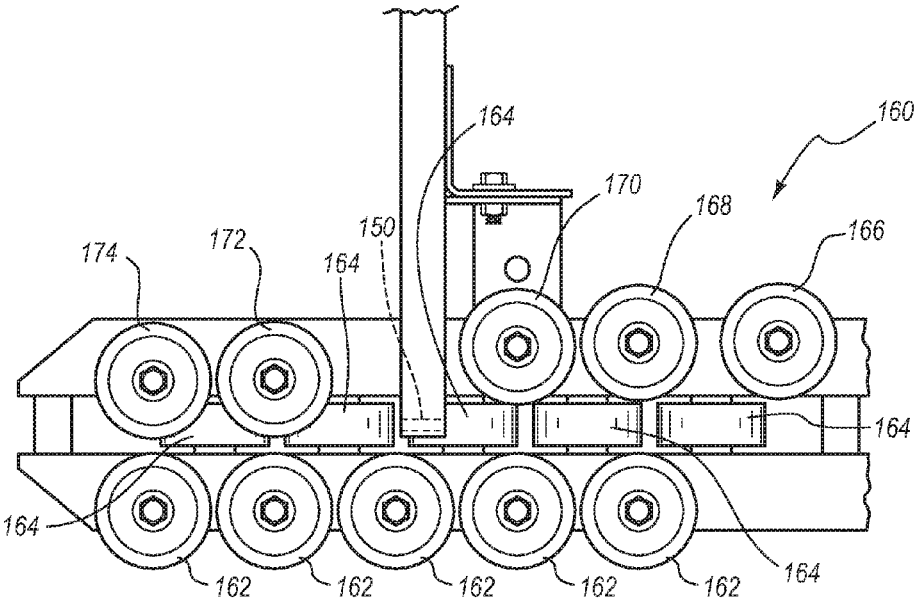
FIG. 7 illustrates a portion of an alternative embodiment of a roller assembly for use with the gluing device of FIG. 1.
Figure 8:
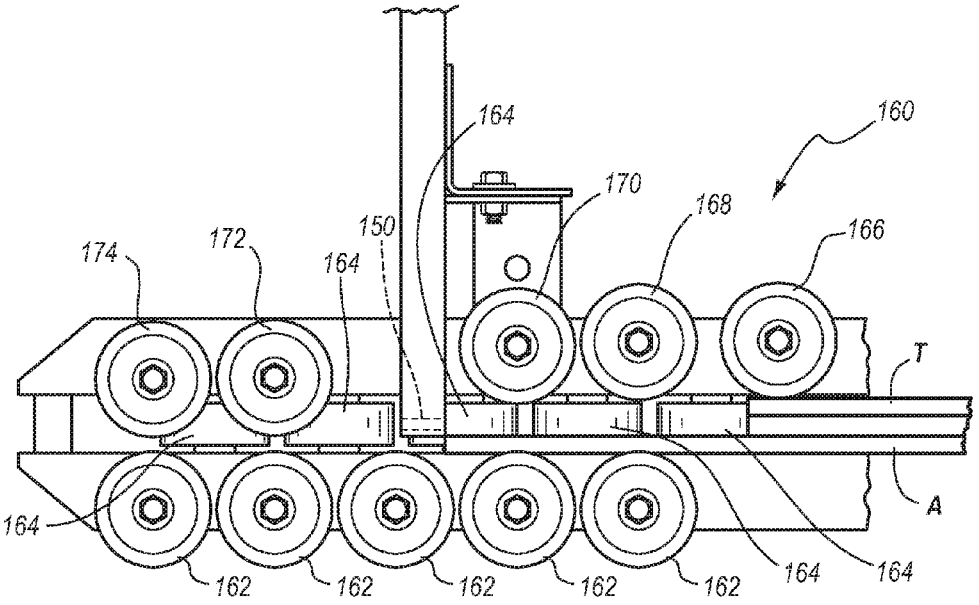
FIGS. 8-11 illustrate the roller assembly of FIG. 7 with a corrugated blank at various positions during the gluing process.
Figure 9:
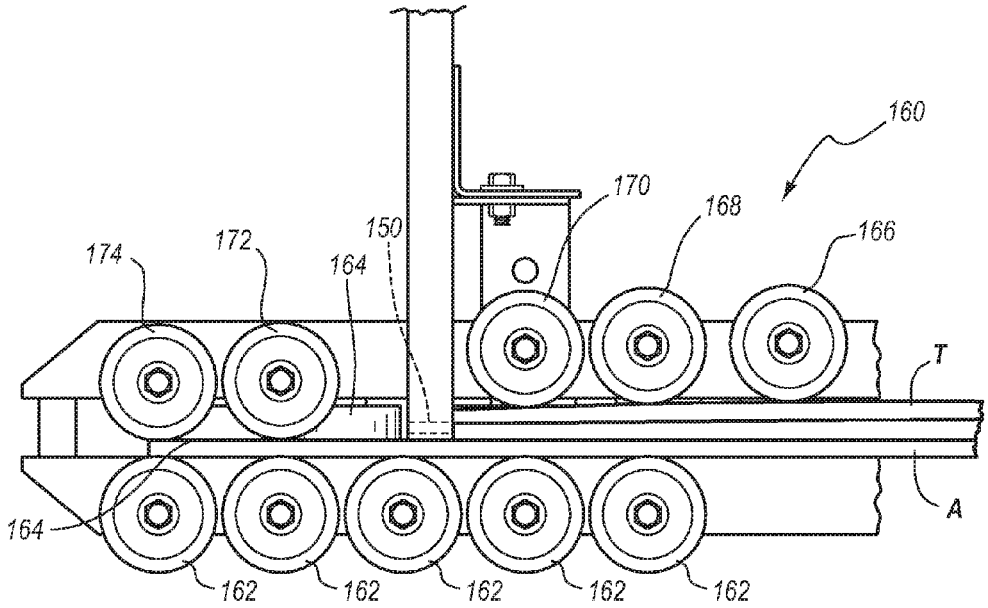

As can be seen in FIGS. 1, 3, and 5B, roller assembly 110 can further include one or more rollers 159 that rotate in a horizontal plane. In the illustrated embodiment, roller 159 is positioned in the same vertical plane that extends between rollers 154, 156 and channel 141. Roller 159 is also positioned so as to contact crease 124 as box blank 106 moves past glue dispensing nozzle 150. This configuration of roller 159 further facilitates the proper positioning and movement of box blank 106 as box blank 106 is processed through gluing device 100.

As seen in FIG. 5B, roller assembly 110 can be positioned relative to glue dispensing nozzle 150 such that the leading edge of box blank 106 and/or glue tab T enters roller assembly 110 while glue dispensing nozzle 150 is still applying glue to the remainder of glue tab T and/or panel A. For example, roller assembly 110 can be positioned between about 2 inches and about 6 inches from glue dispensing nozzle 150. In one embodiment, the distance between glue dispensing nozzle 150 and roller assembly 110 is about 4 inches. As described below, roller assembly 110 can have multiple rollers and glue dispensing nozzle 150 can be positioned therebetween.

The ready progression of box blank 106 past glue dispensing nozzle 150 and into roller assembly 110 can be facilitated by the orientation of glue tab T relative to panel A when glue is applied between glue tab T and panel A. As noted above and illustrated in FIG. 5, glue tab T can be folded so that glue tab T and panel A form an angle θ when glue is applied therebetween. Properly selecting angle θ allows glue tab T to be quickly compressed onto panel A by roller assembly 110 without damaging glue tab T. In particular, as can be seen in FIG. 5B, because angle θ between glue tab T and panel A is relatively small when glue is applied therebetween, compression of the leading portion of glue tab T onto panel A by roller assembly 110 while the trailing portion of box blank 106 is still having glue applied between glue tab T and panel A does not cause undue stress, bending, or damage to glue tab T. Thus, roller assembly 110 can compress a leading portion of glue tab T onto panel A while a trailing portion of glue tab T still forms angle θ so that glue can be applied to the trailing portion of box blank 106, all without damaging glue tab T. In some embodiments, angle θ is between about 10° and about 20°. Similarly, in some embodiments, angle θ is about 15°.

Attention is now directed to FIGS. 7-11, which illustrate an alternative embodiment of a roller assembly that can be incorporated into gluing device 100. The roller assembly 160 of FIGS. 7-11 can be mounted to support plate assembly 138 to provide similar functionality as support plate 108, guide rail 140, and roller assembly 110. In other words, roller assembly 110 and all or a portion of support plate 108 and guide rail 140 can be replaced with roller assembly 160.

In the illustrated embodiment, roller assembly 160 includes a plurality of bottom support rollers 162 and a plurality of side rollers 164 which support box blank 106 and facilitate the alignment and movement of box blank 106 within and through gluing device 100. Specifically, the plurality of bottom support rollers 162 is configured to have at least a portion of box blank 106 rest thereon as box blank 106 moves through gluing device 100. Thus, bottom support rollers 162 can function as and/or replace support plate 108. In this manner, bottom support rollers 162 can be considered a support plate. Therefore, in some embodiments, a planar surface support plate 108 is not included as part of gluing device 100.

Additionally, the plurality of bottom support rollers 162 enable box blank 106 to move thereon with minimal resistance as box blank 106 progresses through gluing device 100. The plurality of side rollers 164 provide a similar function as that described above with reference to vertical wall 144. In particular, side rollers 164 assist in properly aligning box blank 106 as it moves through gluing device 100. For instance, by positioning crease 124 of box blank 106 against side rollers 164, an operator can quickly, easily, and correctly position box blank 106 in and move box blank 106 through gluing device 106. More particularly, by positioning crease 124 of box blank 106 against the plurality of side rollers 164 and moving it therealong, the operator can be assured that box blank 106 is properly aligned with glue dispensing nozzle 150. As with bottom support rollers 162, side rollers 164 provide minimal resistance to the movement of box blank 106 through gluing device 100.

Roller assembly 160 also includes multiple top rollers 166, 168, 170, 172, and 174. Top rollers 166, 168, 170, 172, 174 are positioned vertically above the plurality of bottom support rollers 162, and rotate in generally the same vertical plane as the plurality of support rollers 162. In contrast to roller assembly 110, roller assembly 160 includes rollers before (i.e., to the right of) and after (i.e., to the left of) glue dispensing nozzle 150. The rollers after glue dispensing nozzle 150 perform similar functions to rollers 154, 156 described above. Specifically, top rollers 172, 174 and the bottom support rollers 162 therebelow are configured to compress together glue tab T and panel A after glue has been applied therebetween.

The rollers before glue dispensing nozzle 150, and particularly top rollers 166, 168, 170, can provide functionality similar to that of guide rail 140, and specifically angled ceiling 146 described above. In particular, rollers 166, 168, 170 hold glue tab T relative to panel A so as to form an acute angle. As discussed above, holding glue tab T at an acute angle relative to panel A as box blank 106 moves through gluing device 100 provides multiple benefits. For instance, having rollers 166, 168, 170 hold glue tab T at an acute angle relative to panel A allows glue dispensing nozzle 150 to apply glue between glue tab T and panel A as box blank 106 moves through gluing device 100. Additionally, as glue dispensing nozzle 150 continues to apply glue between glue tab T and panel A, the leading portion of glue tab T can be pressed down onto panel A by rollers 172, 174 without causing undue stress, bending, or damage to glue tab T. Thus, rollers 166, 168, 170 can partially or entirely replace guide rail 140, including angled ceiling 146, or rollers 166, 168, 170 can partially or entirely form a guide rail.

In the illustrated embodiment, top rollers 166, 168, 170 are positioned at different heights from one another. In particular, roller 170 is positioned vertically lower than roller 168, which is positioned vertically lower than roller 166. This configuration provides a tapering pathway through which the portion of box blank 106 that includes glue tab T must pass. Thus, as the edge of panel D that is adjacent crease 124 passes over bottom support rollers 162 towards glue dispensing nozzle 150, top rollers 166, 168, 170 engage glue tab T and progressively press it closer to panel A. Top rollers 166, 168, 170 are angled and configured to position glue tab T generally above glue dispensing nozzle 150 as glue tab T passed glue dispensing nozzle 150. This configuration of top rollers 166, 168, 170 progressively orienting glue tab T can be seen in FIGS. 8 and 9.

Figure 10:
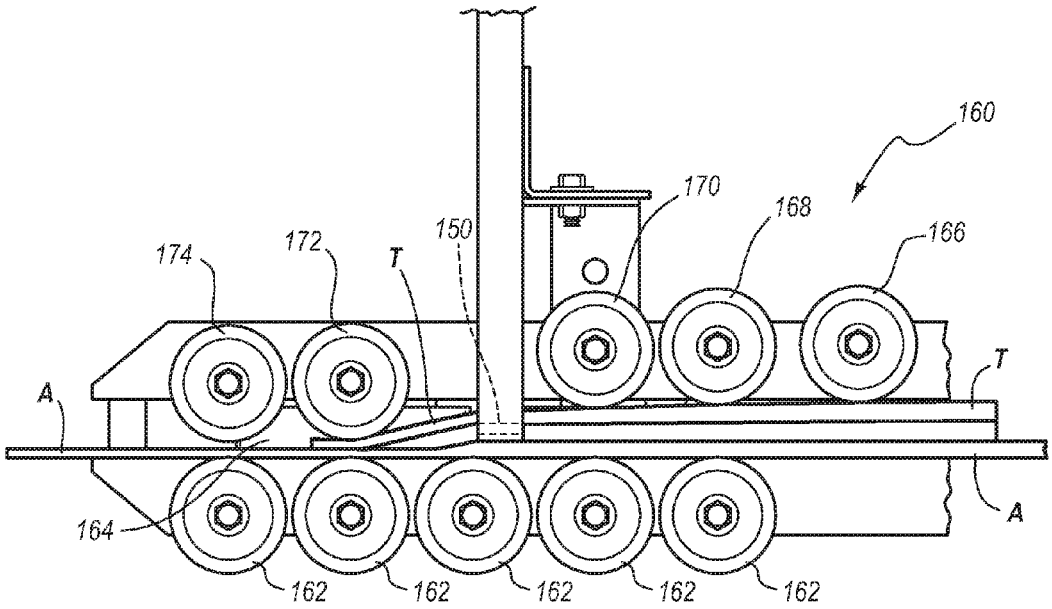
Figure 11:
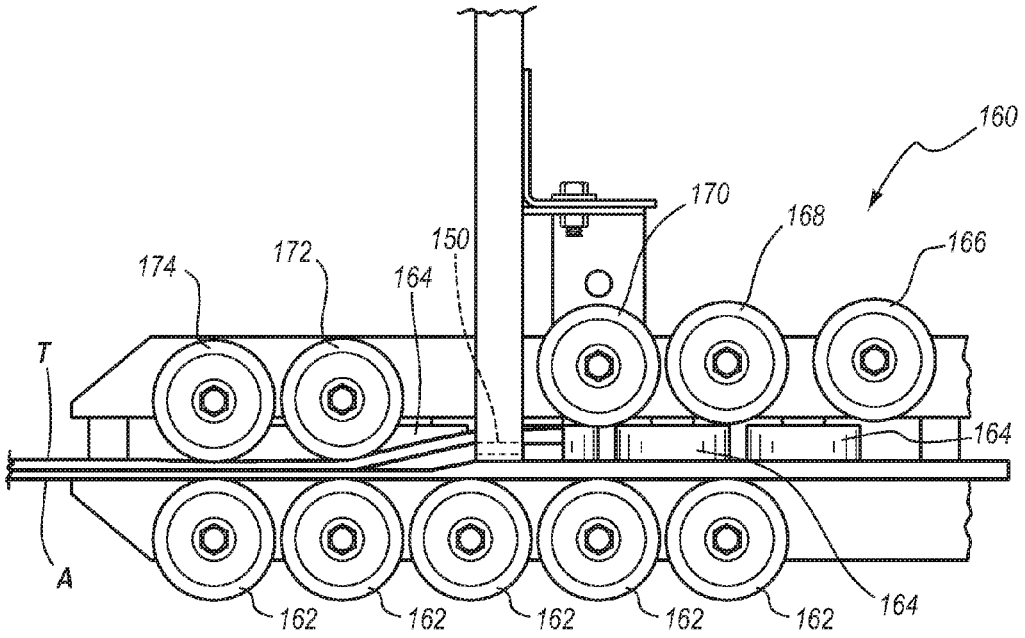

In addition to properly positioning glue tab T for gluing, top rollers 166, 168, 170 are also angled so as to position glue tab T such that rollers 172, 174 can press glue tab T onto panel A without tearing, folding, or placing undo stress on glue tab T, which would diminish the integrity of glue tab T. As can be seen in FIGS. 10 and 11, once glue tab T has passed over glue dispensing nozzle 150, glue tab T encounters top roller 172. Top roller 172 is positioned vertically lower than roller 170. This positioning of roller 172 causes glue tab T to be pressed down onto panel A, between top roller 172 and one of bottom rollers 162. Notably, the vertical displacement of glue tab T caused by the lower position of top roller 172 is minimal. Thus, as glue dispensing nozzle 150 continue to apply glue between glue tab T and panel A, top roller 172 can press the leading portion of glue tab T onto panel A without stretching, tearing, or otherwise injuring glue tab T.

After passing under top roller 172, glue tab T can pass between top roller 174 and another bottom roller 162. The inclusion of top roller 174 can increase the time pressure is applied to glue tab T, thereby providing the glue between glue tab T and panel A additional time to cure.

Similar to roller assembly 110 described with respect to FIGS. 1 and 3-6, the rollers of roller assembly 160 can be manually activated or they can be motorized. For example, the rollers can be free to rotate such that each roller is able to rotate when box blank 106 engages the roller. Alternatively, the rollers can be attached to one or more motors (not shown) to provide an automated feeding system.

Returning attention to FIGS. 1 and 3-6, glue dispensing nozzle 150 of the glue applicator 142 is attached to glue source 148. In the illustrated embodiment, glue source 148 includes a reservoir of glue therein (not shown). The reservoir of glue is in fluid communication with glue dispensing nozzle 150 by way of a conduit 176 through which the glue is communicated between the reservoir and glue dispensing nozzle 150. Conduit 176 can be any suitable structure for transporting the glue, including but not limited to pipes, tubes, hoses, and the like. Glue applicator 142 can also include a pump to facilitate the transfer of glue from the reservoir to glue dispensing nozzle 150. In the illustrated embodiment, the pump is incorporated into glue source 148. In other embodiments, however, the pump can be separate from glue source 148.

Gluing device 100 can be adapted for use with various types of glues. For example, when hot melt glue is used, such as a thermoplastic, the glue reservoir can include a heating element (not shown) in order to melt the glue. The melted glue can then be transferred to glue dispensing nozzle 150 through conduit 176. Other types of glues which can be used with gluing device 100 include cold glues, epoxies, elastomers, polymer-based adhesives, contact adhesives such as neoprene, and pressure sensitive adhesives.

While glue applicator 142 of the present embodiment is described and illustrated as having glue dispensing nozzle 150 attached via conduit 176 to a reservoir of glue, it will be appreciated that various other types of glue applicators can be used with gluing device 100. For example, glue applicator 142 can include a refillable cartridge for receiving glue sticks and a built in heating element for melting the glue prior to application. One example of such a suitable glue applicator is a 3M Scotch Weld Hot Melt applicator. Such a glue applicator can be simple and convenient to use. For example, the glue applicator can be mounted to the gluing device support structure as described herein. A user can readily activate the glue applicator by pressing a button, pulling a trigger, or the like. One of ordinary skill in the art will readily recognize other suitable types of glue applicators than can be used with the gluing device of the present invention.

Gluing device 100 can also include various features that increase the convenience of using gluing device 100. For example, gluing device 100 of the present embodiment can include a folding bar (not shown) similar to the folding bar described elsewhere herein. The folding bar can be mounted to support structure 102 and can be configured to fold glue tab T of box blank 106 to the position illustrated in FIG. 2B, for example. More specifically, the portion of support plate 108 opposite roller assembly 110 and glue applicator 142 can extend further out beyond guide rail 140. The folding bar can be attached to a side of this portion of support plate 108. Box blank 106 can be positioned on this end of support plate 108 with glue tab T positioned above the folding bar. The folding bar can be rotated to fold glue tab T onto panel A. Furthermore, the folding bar can be adapted to only rotate a certain amount in order to fold glue tab T to a desired angle θ, as described herein.

While the present embodiment has been described and illustrated with a generally stationary frame, support plate, and glue applicator, thereby requiring movement of the box blank relative to the support frame in order to glue the box blank, it will be appreciated that other configurations are contemplated within the scope of the present invention. For example, the gluing device of the present invention can be adapted to move relative to the box blank in order to apply glue thereto and compress the glued surfaces together. More specifically, in an embodiment where the box blank is held stationary, either by a machine or an operator, the gluing device may be adapted to move back and forth relative to the box blank. As the gluing device is moved in one direction, the rollers or guide rail would move over the glue tab and position it as described above. The dispensing nozzle would move between the glue tab T and panel A, and the rollers would press the glued surfaces together.

Attention is now directed to FIGS. 12-15, in which is illustrated a gluing device 200 according to another exemplary embodiment of the present invention. Generally, gluing device 200 according to the present embodiment includes a support structure 202 and a glue applicator 204 which facilitate the gluing of packaging materials, such as box blanks 106. Support structure 202 includes two upright supports 206 and a cross beam 208 that extends between and to which upright supports 206 are attached. Also extending between and attached to upright supports 206 is a support plate 210. Support plate 210 is configured to have a packaging material, such as box blank 106, positioned thereon and secured in place while glue applicator 204 applies glue thereto. Additionally, a folding bar 212 can be hingedly coupled to support plate 210, or alternatively to support structure 202, and can be configured to selectively fold a portion of the packaging material 106.

Figure 12:
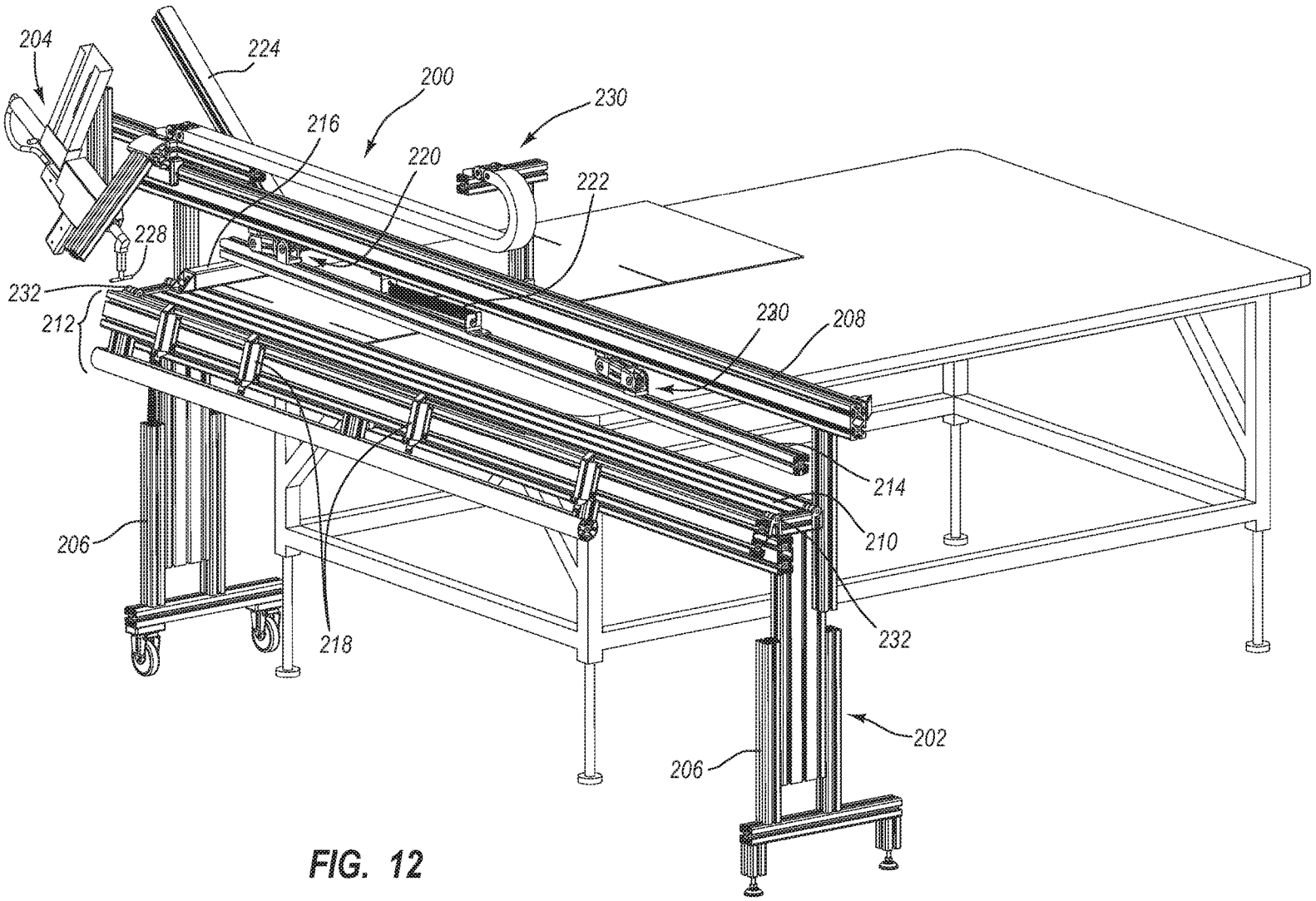
FIG. 12 illustrates a front perspective view of an exemplary gluing device according to another embodiment of the present invention.
Figure 13:
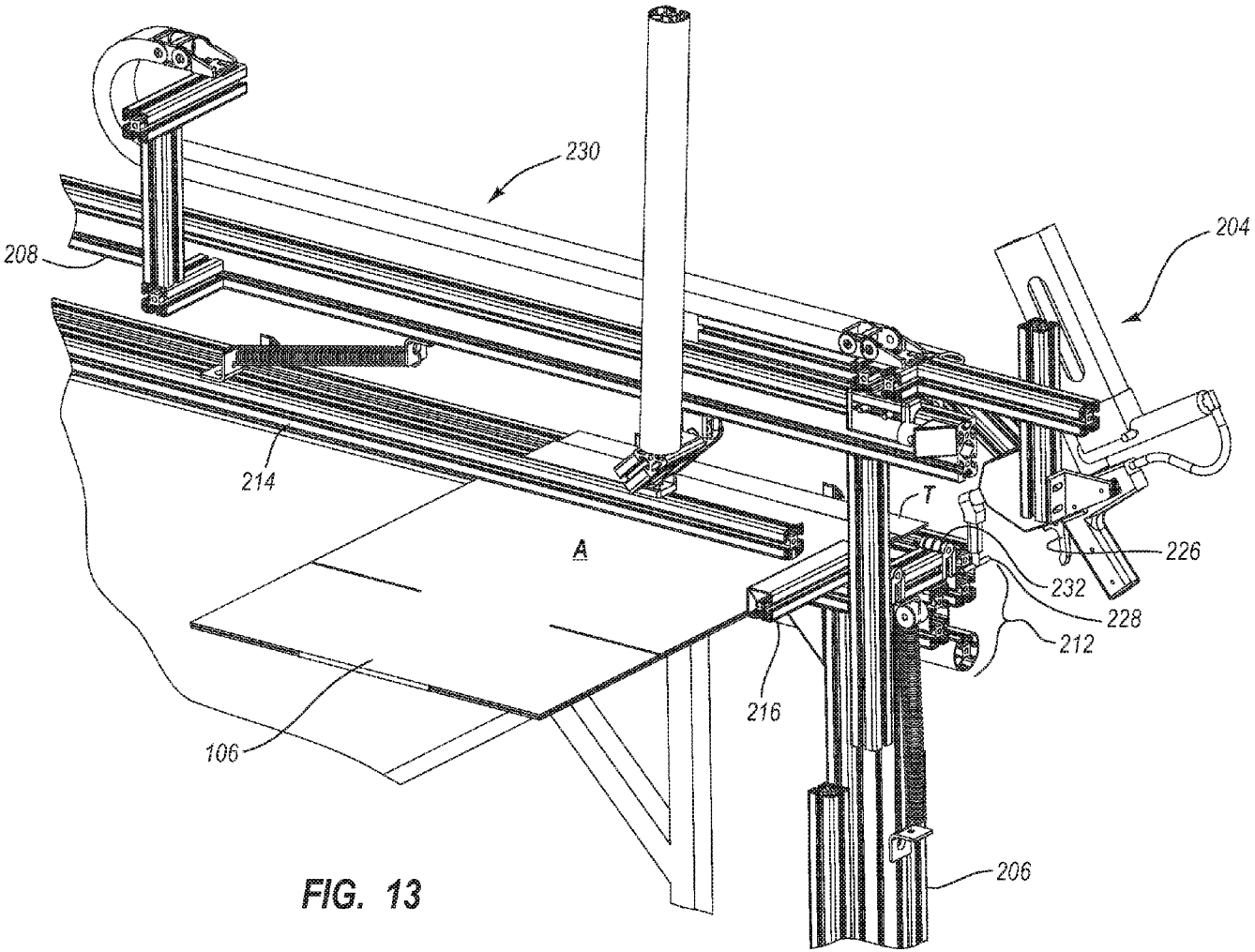
FIG. 13 illustrates a partial rear perspective view of the gluing device of FIG. 12 with a box blank secured therein.

As can be seen in FIG. 12, support plate 210 is positioned vertically below cross beam 208 such that support plate 210, cross beam 208, and upright supports 206 define a generally rectangular opening in gluing device 200. Box blank 106 can be received at least partially within the opening defined by support plate 210, cross beam 208, and upright supports 206. When received within the opening, box blank 106 can be supported on support plate 210 as shown in FIG. 12. When box blank 106 is positioned on support plate 210, a clamp arm 214 can be lowered onto box blank 106 to securely hold box blank 106 in place on support plate 210 as shown in FIG. 13.

Gluing device 200 can also include one or more guide rails 216 and one or more stops 218 that facilitate ready and proper positioning of box blank 106 on support plate 210. For instance, prior to securing box blank 106 in place with clamp arm 214, an operator may position one edge of box blank 106 against guide rail 216 and an edge of glue tab T against one or more stops 218, as shown in FIG. 12. Guide rail 216 and stops 218 enable a user to properly position box blank 106 on support plate 210 so that glue applicator 204 applies glue to the desired portion of box blank 106 and so that folding bar 212 folds the desired portion of box blank 106.

In the illustrated embodiment, guide rail 216 comprises a bar that is secured to and extends from support plate 210. The physical nature of the illustrated guide rail 216 allows an operator to quickly position and orient box blank 106 against guide rail 216, relying on feel rather than a visual inspection to ensure the proper positioning of box blank 106. Similarly, stops 218 comprise physical barriers against which box blank 106 can be positioned. In the illustrated embodiment, stops 218 are attached to and extend up from folding bar 212. Stops 218 prevent box blank 106 from being inserted too far into the opening formed by support plate 210, cross beam 208, and upright supports 206. Stops 218 can allow an operator to quickly position and orient box blank 106 against stops 218, relying on feel rather than a visual inspection to ensure the proper positioning of box blank 106.

Thus, an operator may slide box blank 106 into the opening and quickly position box blank up against guide rail 216 and stops 218 so that box blank 106 is ready to be glued and folded in the desired locations. It will be understood, however, that guide rail 216 and stops 218 can take other configurations. For instance, guide rail 216 and stops 218 can be visual indicators, such as lines, indicating where box blank 106 should be positioned. Alternatively, guide rail 216 and stops 218 can also include sensors and/or alerting means, such as a lights, alarms, or the like, that provides an indication to an operator where to position box blank 106 or that box blank 106 is properly positioned on support plate 210.

Once box blank 106 is properly positioned on support plate 210, clamp arm 214 can be lowered onto box blank 106 so securely hold box blank 106 in place. As illustrated in FIGS. 12 and 13, clamp arm 214 is attached to support structure 202 so that it is positioned above support plate 210. More specifically, clamp arm 214 is movably coupled to cross beam 208 by way of one or more hinge couplings 220 and spring 222 such that clamp arm 214 can be selectively moved between a raised position (see FIG. 12) and a lowered position (see FIG. 13). Clamp arm 214 can be adapted to maintain its current position. For example, clamp arm 214 can be adapted to stay in the raised position until an operator manually lowers clamp arm 214. Similarly, clamp arm 214 can be adapted to remain in the lowered position until an operator manually raises clamp arm 214. In this manner clamp arm 214 will not undesirably raise or lower when an operator does not intend clamp arm 214 to raise or lower, such as during a gluing process.

Clamp arm 214 can include a lever 224 that enables an operator to readily move clamp arm 214 as desired. For example, once box blank 106 has been properly positioned on support plate 210 for gluing, an operator can manipulate lever 224, such as by pushing, pulling, or rotating lever 224, to cause clamp arm 224 to lower onto box blank 106, as seen in FIG. 13. When in the lowered position, clamp arm 214 is adapted to cooperate with support plate 210 to securely hold box blank 106 in place during the gluing process.

Clamp arm 214 can be adapted to lower a specific distance, thereby creating just enough clearance for box blank 106 between clamp arm 214 and support plate 210 so that clamp arm 214 does not damage box blank 106. In some embodiments, clamp arm 214 can be adapted to lower until a specific force is reached. Thus, clamp arm 214 can automatically adjust to box blanks 106 of different thicknesses.

With box blank 106 secured in the desired position on support plate 210, as shown in FIG. 13, glue applicator 204 can be used to apply glue to a portion of box blank 106. In the illustrated embodiment, glue applicator 204 comprises a 3M Scotch Weld Hot Melt applicator. Glue applicator 204 is mounted on cross beam 208 so that is can be moved back and forth over the top of box blank 106. Glue applicator 204 can be activated is a similar manner as described above. For example, an operator can activate glue applicator 204 by pressing a button 226, pulling a trigger, moving a lever, or the like. Similarly, glue applicator 204 can be equipped with an automated activation system as described above. For example, glue applicator 204 can include one or more sensors (not shown) that detect when a glue dispensing nozzle 228 of glue applicator 204 is positioned over box blank 106. When so positioned, glue applicator 204 can be adapted to apply glue to box blank 106. Thus, an operator can move glue applicator 204 so that glue dispensing nozzle 228 is over box blank 106 and either manually activate glue applicator 204 or have glue applicator 204 automatically activated so as to apply glue to the desired surface(s) of box blank 106. As will be understood, when glue applicator 204 is moved over box blank 106 and activated, glue can be applied to one or more surfaces of box blank 106. For instance, glue dispensing nozzle 228 can apply glue to glue tab T, near an edge of panel A, or both.

In conjunction with glue applicator 204, support structure 202 can also have a cable and hose carrier system 230 mounted thereon. Cable and hose carrier system 230, such as a KabelSchlepp linkage system, can be adapted to run needed power supply lines, such as electrical wires and compressed air hoses, to glue applicator 204. Cable and hose carrier system 230 enables the wires and hoses to be contained within a safe, pliable structure, thereby reducing or eliminating the likelihood of damage to the cables or hoses while allowing for ready movement of glue applicator 204.

Figure 14:
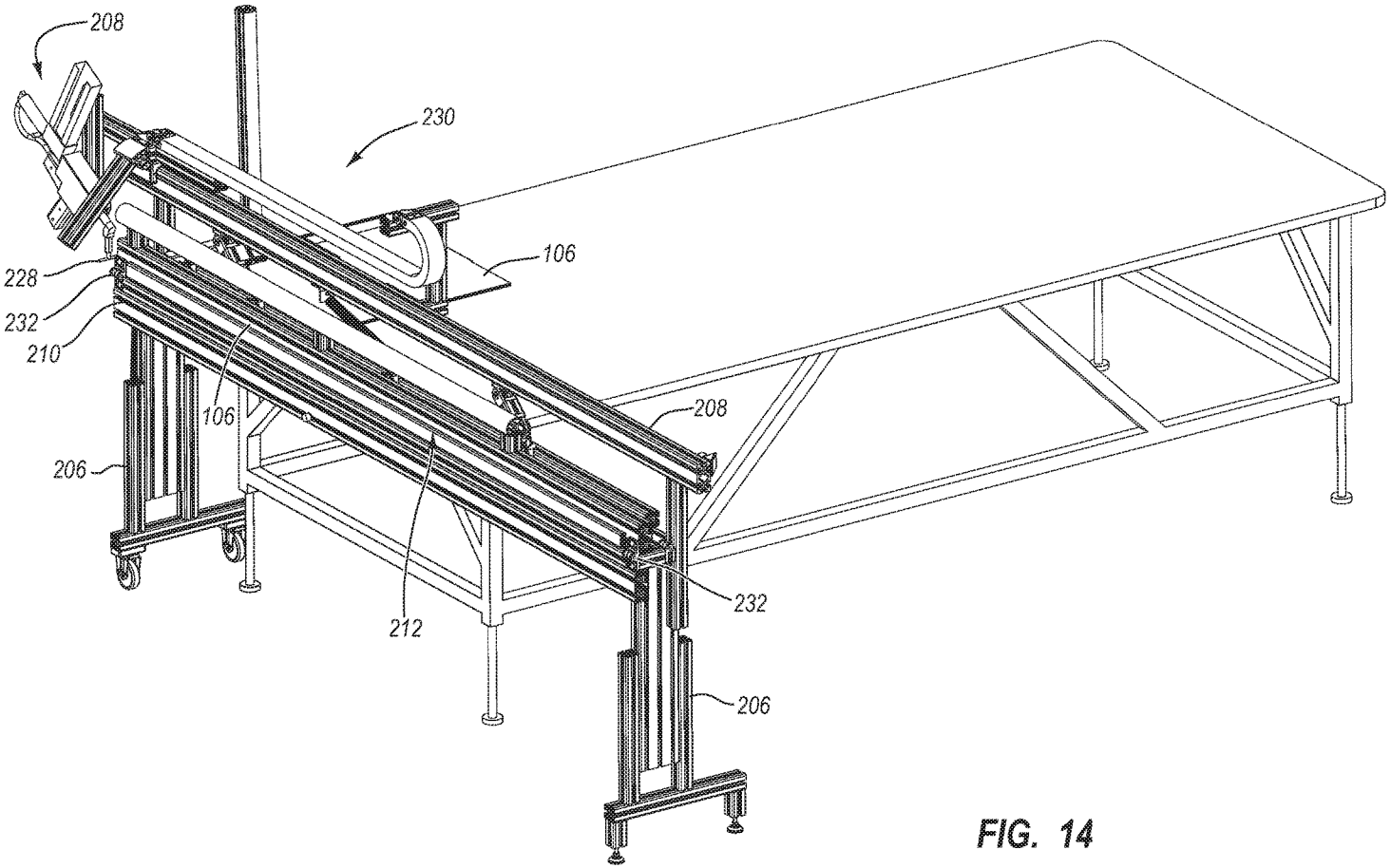
FIG. 14 illustrates a front perspective view of the gluing device of FIG. 12 with the box blank securely positioned therein and the box blank's glue tab folded over with the gluing device's folding bar.

As can be seen in FIGS. 12 and 13, when box blank 106 is secured in the desired position on support plate 210, glue tab T is positioned on top of folding bar 212, panel D (not shown) is positioned directly on top of support plate 210, panel A is positioned on top of panel D, and crease 124 between glue tab T and panel A is positioned over the hinged area between support plate 210 and folding bar 212. Thus, after glue is applied to glue tab T and/or panel A, folding bar 212 can be rotated to fold glue tab T onto panel A as shown in FIG. 14. In particular, with glue applied to box blank 106, folding bar 212 can be rotated, via hinges 232, upward from the position shown in FIGS. 12 and 13 to the position shown in FIGS. 14 and 15. Upward rotation of folding bar 212 folds glue tab T along crease 124 over onto panel A. Folding bar 212 can also be used to apply pressure on glue tab T to assist in bonding the glue to panel A and glue tab T. Specifically, folding bar 212 can be pressed and held in this upward position to ensure adequate adhesion between glue tab T, panel A, and the glue therebetween.

It is notable that stops 218 that are attached to folding bar 212 are adapted to retract into folding bar 212 when folding bar 212 is rotated as described above. For example, in one embodiment, stops 218 are spring loaded within folding bar 212. Thus, when pressure is applied to the ends of stops 218, stops 218 are able to retract into folding bar 212. Thus, when folding bar 212 is rotated upward and stops 218 encounter the top surface of panel A, rather than puncturing panel A, stops 218 retract into folding bar 212. When folding bar 212 is rotated downward away from box blank 106, stops 218 are pushed back out of folding bar 212 by internal springs (not shown).

Once glue tab T has been attached to panel A, folding bar 212 can be rotated back to its original position as shown in FIG. 12, and clamp arm 214 can be lifted off of box blank 106, thereby allowing removal of box blank 106 from gluing device 200. The glued box blank 106 can then be erected and used, or stacked and saved for later use.

Figure 15:
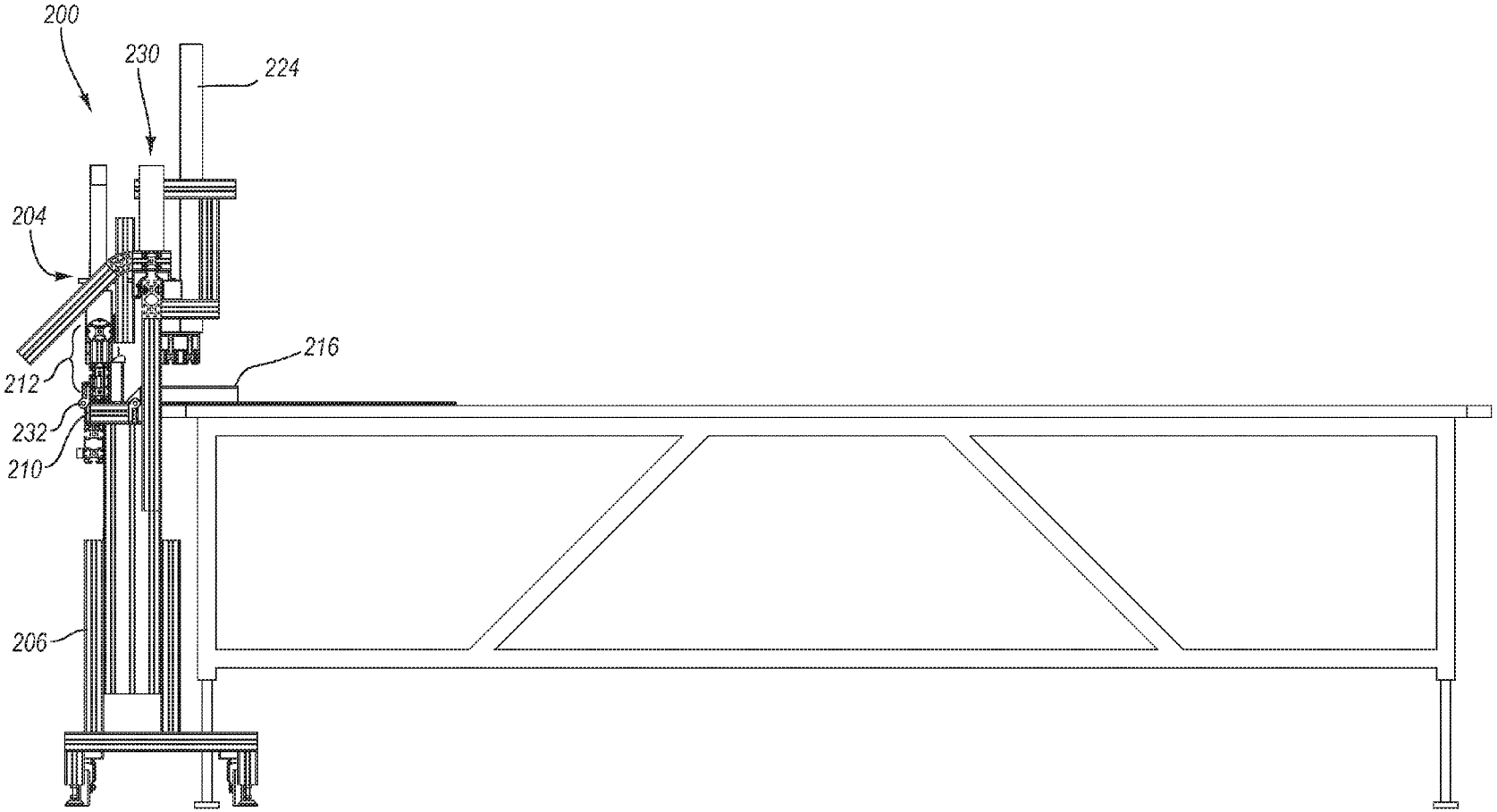
FIG. 15 illustrates a side view of the gluing device of FIG. 12.

As can be seen in the Figures, and particularly FIG. 15, the present embodiment of gluing device 200 is relatively narrow. This feature of gluing device 200 is particularly advantageous when gluing device 200 is used as one of a series of box making devices, or when gluing device 200 is used periodically and needs to be stored at other times. For instance, the narrow dimensions of gluing device 200 allows the device to be positioned between other machines without requiring the other machines to be spaced a great distance apart. Likewise, when gluing device 200 is not in use, it can be moved against a wall, for example, without taking up large amounts a valuable storage or manufacturing space.

Gluing device 200 can be used independently, or it can be positioned next to a table or counter in order to increase the available working area for gluing device 200. As illustrated in FIGS. 12-15, gluing device 200 is positioned next to a table that can assist in supporting box blank 106 while box blank 106 is being glued. Alternatively, gluing device 200 can be formed with a larger support structure 202 and/or support plate 210.

Gluing device 200 can also be sized to glue one ore more box blanks 106 at a time. As described above, gluing device 200 received and glued a single box blank 106. Alternatively, however, multiple box blanks 106 can be positioned side-by-side and secured in place with clamp arm 214. Glue can then be applied to each of box blanks 106 and folding bar 212 can be used to simultaneously fold each glue tab T of the multiple box blanks 106. Furthermore, the multiple box blanks 106 may be distinct box blanks 106 which are individually placed on support plate 210, or the multiple box blanks 106 may be attached to one another as a unit such that the unit is placed on support plate 210 at one time. In the case of the attached box blanks 106, the attached box blanks 106 can be adapted to be readily detached from one another after the gluing process is complete. In this manner multiple box blanks 106 can be glued in a single gluing process, thereby increasing the number of boxes that can be formed in a given time period.

One of the advantageous features of the present invention is that box blanks of various sizes can be glued without having to adjust the configuration or settings of the gluing device. For example, gluing device 100 can be used to glue the glue tab of a very large box blank by simply sliding the edge of the folded box blank with the glue tab through guide rail 140, past glue dispensing nozzle 150, and through roller assembly 110, as described above. Once the large box blank has been glued, another box blank of a different size can be immediately glued with gluing device 100 by following the same procedure. There is not need to reconfigure or adjust any parts of gluing device 100 in order to accommodate box blanks of different sizes. The same holds true for gluing device 200. Specifically, a box blank of one size may be held in place, glued, and folded using gluing device 200, and immediately thereafter another box blank of a different size can be glued without adjusting any parts of gluing device 200. Thus, the gluing devices of the present invention enable on demand, or custom sized boxes to be glued one after another without any downtime to adjust the gluing device.

This feature of the invention is in contrast to most typical gluing devices that require specific settings for each size box. More specifically, most box gluing device are configured to glue box blanks in batches based on the size of the box blanks. For instance, the gluing device can be set to glue a 20"×20"×20". With these settings, a batch of box blanks, anywhere from dozens to hundreds of box blanks, will be glued. These box blanks are then stacked and shipped to consumers. When another batch of box blanks that are, for example, 10"×8"×6", needs to be glued, the setting of the gluing device must be reset to accommodate the different sized box blanks. Thus, each time a new size box blank needs to be glued, the settings of the gluing device need to be adjusted. In contrast, the gluing device of the present invention is designed to gluing various sized box blanks one after another without having to make any adjustments to the gluing device.

While the various embodiments of the present invention have been shown and described as being able to glue box blank 106 in a generally horizontal orientation, it will be appreciated that the gluing device of the present invention can be oriented in any desired manner. For example, the support structures, support plates, glue applicators and the like of the various embodiments can be positioned at various angles. In this manner, the gluing device of the present invention can be adapted to receive and glue a box blank in horizontal, vertical, or any other orientation therebetween. Reconfiguring the gluing device in a more vertical manner can provide significant savings in terms of square footage used in a warehouse or other facility.

The gluing devices of the present invention are also particularly advantageous when the box blanks being glued are formed from a supply of endless packaging material, such as corrugated cardboard, that has been folded in a fanfold configuration. As will be understood, when a supply of an endless packaging material, such as corrugated cardboard, is folded in a fanfold configuration, creases or folds are formed in the packaging material.

The fanfold creases can cause some difficultly when forming boxes out of the packaging material. For instance, when a box blank is cut from a fanfolded packaging material, the fanfold crease may not align with the creases used to form the various panels of the box blanks. By way of example, a fanfold crease may extend down the middle of one of the panels or the glue tab. These fanfold creases can cause the box blank not to lie flat, which can cause the panels and glue tab not to readily align when the glue tab is to be glued. This can cause the operator to have to hold the panels and glue tab in place while the glue tab is being attached.

The gluing devices of the present invention minimizes the difficulties present by these fanfold creases. Since the gluing device of the present invention apply glue and attach the glue tab when the glue tab is positioned on the edge of the box blank, the only time the fanfold creases pose any real difficulty is when the fanfold crease extends down the middle of the glue tab. However, the frequency with which the fanfold crease will extend down the middle of the glue tab is very minimal Additionally, the guide rails, roller assemblies, clamp arms, and folding bars described above, further minimize any difficultly created by the fanfold creases. For instance, folding bar 212 can apply enough pressure to the glue tab when folding the glue tab onto panel A so as to flatten out any fanfold creases. Similarly, the pressure applied to the glue tab by the roller assemblies described above can also flatten out any fanfold crease that may exist in the glue tab.

Thus, the gluing devices of the present invention provide a quick and convenient means for gluing box blanks of practically any size or dimension without having to adjust or reconfigure the device between box blank sizes, while also reducing or eliminating the potential difficulties encountered from using fanfold packaging materials.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A gluing device, comprising:

a support structure;

a support plate mounted on the support structure, the support plate being adapted to have packaging material positioned thereon;

a clamp arm movably coupled to the support structure with one or more hinge couplings, the clamp arm being adapted to selectively and securely hold the packaging material in place on the support plate, wherein the clamp arm is adapted to hold the packaging material in place when the clamp arm is moved from a first position to a second position;

a gluing apparatus movably mounted on the support structure such that the gluing apparatus can be selectively moved between a first position and a second position on the support structure, the gluing apparatus having a glue dispensing nozzle and a glue supply, wherein the gluing apparatus is adapted to apply glue to at least one surface of the packaging material, wherein the at least one surface is disposed adjacent an edge of the packaging material; and a folding bar hingedly coupled to the support structure, wherein the folding bar is adapted to fold a first portion of the packaging material onto a second portion of the packaging material to secure the two portions together.

2. The gluing device of claim 1, wherein at least one of the first portion or second portion of the packaging material comprises the at least one surface upon which glue is applied.

3. The gluing device of claim 1, further comprising one or more guide rails to facilitate ready alignment and positioning of the packaging material on the support plate.

4. The gluing device of claim 1, wherein the folding bar comprises one or more stops that facilitate proper positioning of the packaging material on the support plate.

5. The gluing device of claim 4, wherein the one or more stops are retractable within the folding bar.

6. The gluing device of claim 1, wherein the packaging material comprises at least one box blank, wherein the support plate and the clamp arm are sized and configured to simultaneously receive multiple box blanks.

7. The gluing device of claim 1, wherein the gluing apparatus is disposed above the folding bar.

8. The gluing device of claim 1, further comprising a spring connected between the support structure and the clamp arm.

9. A gluing device, comprising:

a support plate having a surface adapted to have packaging material positioned thereon;

a clamp arm movable between a first position and a second position relative to the support plate, wherein the clamp arm is adapted to allow for positioning of the packaging material on the surface of the support plate when the clamp arm is in the first position, and wherein the clamp arm is adapted to selectively and securely hold the packaging material in place on the surface of the support plate when the clamp arm is in the second position;

a gluing apparatus having a glue dispensing nozzle and a glue supply, wherein the glue dispensing nozzle is movably mounted over the surface of the support plate such that the glue dispensing nozzle can be selectively moved across the surface of the support plate, wherein the gluing apparatus is adapted to apply glue to a first surface of the packaging material, wherein the first surface is disposed adjacent an edge of the packaging material; and a folding bar hingedly coupled to the support plate, wherein the folding bar is adapted to fold a first portion of the packaging material onto a second portion of the packaging material with the glue disposed between the first and second portions to thereby secure the two portions together, wherein the folding bar comprises one or more stops that facilitate proper positioning of the packaging material on the surface of the support plate, wherein the one or more stops are retractable such that the one or more stops retract into the folding bar when the folding bar is rotated to fold the first portion of the packaging material onto the second portion of the packaging material.

10. The gluing device of claim 9, wherein one of the first portion and the second portion of the packaging material comprises a glue tab of a box blank, and the other of the first portion and the second portion comprises a panel of the box blank.

11. The gluing device of claim 9, wherein the clamp arm includes a lever to facilitate movement of the clamp arm between the first position and the second position.

12. The gluing device of claim 9, wherein the packaging material comprises a box blank.

13. A gluing device, comprising:

a support plate having a surface adapted to have packaging material positioned thereon;

a clamp arm disposed opposite the support plate such that the packaging material may be disposed between the support plate and the clamp arm, the clamp arm being movable between a first position and a second position relative to the support plate, wherein the clamp arm is adapted to allow for positioning of the packaging material on the surface of the support plate and between the support plate and the clamp arm when the clamp arm is in the first position, and wherein the clamp arm is adapted to selectively and securely hold the packaging material in a stationary position on the surface of the support plate and between the support plate and the clamp arm when the clamp arm is in the second position;

a gluing apparatus having a glue dispensing nozzle and a glue supply, wherein the glue dispensing nozzle is movably mounted over the surface of the support plate such that the glue dispensing nozzle can be selectively moved across the surface of the support plate to apply glue to the packaging material while the packaging material is in the stationary position, wherein the gluing apparatus is adapted to apply glue to a first surface of the packaging material, wherein the first surface is disposed adjacent an edge of the packaging material; and a folding bar hingedly coupled to the support plate, wherein the folding bar is adapted to fold a first portion of the packaging material onto a second portion of the packaging material with the glue disposed between the first and second portions to thereby secure the two portions together, wherein the folding bar and the glue dispensing nozzle are movable independent from one another.

14. The gluing device of claim 13, wherein the folding bar comprises one or more stops that facilitate proper positioning of the packaging material on the surface of the support plate, wherein the one or more stops are retractable such that the one or more stops retract into the folding bar when the folding bar is rotated to fold the first portion of the packaging material onto the second portion of the packaging material.

15. The gluing device of claim 13, further comprising a support structure, wherein the clamp arm is movably coupled to the support structure with one or more hinge couplings.

16. The gluing device of claim 15, further comprising a spring connected between the support structure and the clamp arm.

17. The gluing device of claim 13, wherein the clamp arm, the glue dispensing nozzle, and the folding bar are each movable independent from one another.

18. The gluing device of claim 13, further comprising one or more guide rails to facilitate ready alignment and positioning of the packaging material on the support plate.

19. The gluing device of claim 13, wherein the gluing apparatus is disposed above the folding bar and opposite the support plate.

* * * * *